US006985132B2

(12) United States Patent
Nomura et al.

(10) Patent No.: US 6,985,132 B2
(45) Date of Patent: Jan. 10, 2006

(54) DISPLAY DEVICE AND METHOD FOR MANUFACTURING THE SAME

(75) Inventors: Noboru Nomura, Kyoto (JP); Tohru Nakagawa, Shiga (JP); Masahiro Nagasawa, Osaka (JP); Tadashi Ootake, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 552 days.

(21) Appl. No.: 09/995,511

(22) Filed: Nov. 27, 2001

(65) Prior Publication Data

US 2002/0126261 A1 Sep. 12, 2002

(30) Foreign Application Priority Data

Nov. 29, 2000 (JP) ..... 2000-362429

(51) Int. Cl.
*G09G 3/34* (2006.01)

(52) U.S. Cl. ..... 345/107; 345/85; 359/296

(58) Field of Classification Search ..... 345/107, 345/84–87; 349/296; 264/4, 7; 359/296
See application file for complete search history.

(56) References Cited

U.S. PATENT DOCUMENTS 4,126,854 A 11/1978 Sheridon
4,143,103 A * 3/1979 Sheridon ..... 264/4
4,298,448 A 11/1981 Muller et al.
4,438,160 A 3/1984 Ishikawa et al.
4,810,431 A 3/1989 Leidner
5,604,027 A 2/1997 Sheridon
5,708,525 A * 1/1998 Sheridon ..... 359/296
5,815,306 A * 9/1998 Sheridon et al. ..... 359/296
5,894,367 A 4/1999 Sheridon
5,900,858 A * 5/1999 Richley ..... 345/107
6,072,621 A 6/2000 Kishi et al.

(Continued)

FOREIGN PATENT DOCUMENTS

EP 849 003 6/1998

(Continued)

OTHER PUBLICATIONS

"The Gyricon—A Twisting Ball Display"; Sheridon et al.; Proceeding of the S.I.D.; vol. 18/3 & 4; pp. 289-293; 1977.

(Continued)

*Primary Examiner*—Xiao Wu
(74) *Attorney, Agent, or Firm*—Hamre, Schumann, Mueller & Larson, P.C.

(57) ABSTRACT

A display device using a cylinder-shaped pixel having a large dipole moment and high response speed and a method for manufacturing the same. In the display device, an organic film is bonded and fixed to a part of or an entire surface of a base material having a volume of less than 1 $cm^3$ via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounting for 40% or more and 60% or less of the surface area of the base material, a plurality of charged substances in different charged states or with opposite polarities in the two regions. The plurality of charged substances are dipped in liquid between a pair of substrates each having an electrode, and voltage is applied to the electrode, thereby enabling the charged substances to be rotated.

17 Claims, 19 Drawing Sheets

U.S. PATENT DOCUMENTS

| | | | | |
|---|---|---|---|---|
| 6,137,467 | A | 10/2000 | Sheridon | |
| 6,822,781 | B1 * | 11/2004 | Amici et al. | 359/296 |

FOREIGN PATENT DOCUMENTS

| | | |
|---|---|---|
| JP | 55-110225 | 8/1980 |
| JP | 56-67886 | 6/1981 |
| JP | 56-67887 | 6/1981 |
| JP | 58-123579 | 7/1983 |
| JP | 64-42683 | 2/1989 |
| JP | 1-282589 | 11/1989 |
| JP | 6-102830 | 4/1994 |
| JP | 8-234686 | 9/1996 |
| JP | 9-179505 | 7/1997 |
| JP | 10-149120 | 6/1998 |
| JP | 10-175267 | 6/1998 |
| JP | 11-85066 | 3/1999 |
| JP | 2000-35768 | 2/2000 |

OTHER PUBLICATIONS

Partial Translation of General Document: Journal of the Imaging Society of Japan; vol. 38 No. 2 (1999); "An Electrical Twisting Ball Display"; Masaki Saito; pp. 143-147.

Partial Translation of General Document: "An Introduction to Organic Ultra-thin Film"; Yabe et al.; pp. 122-137 (1998). Langmuir; vol. 6, No. 11; pp. 1621-1627 (1990).

Partial Translation of General Document: Nikkei Microdevices, Feb. 2001, pp. 113-119.

* cited by examiner

DISPLAY DEVICE AND METHOD FOR MANUFACTURING THE SAME

BACKGROUND OF THE INVENTION

1. Field of the Invention

The present invention relates to a display device using pixels in shapes of rotating cylinder, etc. More specifically, the present invention relates to a display device in which a plate-shaped or a cylinder-shaped pixels having a half part that is colored and having, on the surface, an organic molecular film carrying positive and negative charges to generate a dipole moment are dipped in liquid; the pixels dipped in liquid are disposed between electrodes and at least one of the electrodes located in a path in which light passes is transparent; and voltage is applied to the electrodes so as to rotate the pixels.

2. Description of the Prior Art

A display device using pixels in shapes of a rotating ball or a rotating cylinder has been proposed as a twist ball display by N. K. Sheridon et al. in 1977 (Proceeding of the SDI, vol. 18/3 & 4, p289, 1977). In such a display device, minute balls, each having a colored half surface, are sandwiched between counter electrodes, one of which is transparent, arranged in a two-dimensional matrix, and the minute balls are present in a liquid electrolyte. One half surface of the minute balls has a surface charge which has an opposite polarity to the those of another half surface. Thus, the minute balls have a dipole moment as a whole. At this time, when voltage is applied to one of the portions between the counter electrodes, the minute balls are rotated by an electric field in the direction in which the direction of the dipole moment is the same as the direction of the electric field. Therefore, by applying a predetermined voltage to each counter electrode, each minute ball is rotated in accordance with the applied voltage and functions as a pixel.

In a conventional display, in order to provide the surface of the minute balls with charge, a half surface of the balls including titanium oxide was coated with a chalcogen-based inorganic material, etc. by a vacuum deposition method, etc. Since each material has a predetermined zeta potential in the liquid electrolyte, respectively, by appropriately selecting a coating material, the balls were provided with dipole moments and were able to be used as pixels.

However, in general, inorganic materials are required to be exposed to a strongly alkaline or strongly acid solution to increase the surface charge density. However, it is not preferable to use such a solution since there is a problem from a view of the safety, that is, the requirements for the apparatus for housing a solution.

Furthermore, in order to provide the ball with a large dipole moment, a coating material for coloring was limited, thus limiting the colors to be used for coloring a display. For such reasons, the dipole moment of the minute ball used for the twist ball display was small. Therefore, in order to rotate the minute ball, it was necessary to add an electric field as large as several kilo volt/cm (Maski Saito, "Journal of the Imaging Society of Japan" vol. 38, No. 2, p 143 in 1999).

Furthermore, in order to realize the twist ball display, various manufacturing methods have been proposed, for example, by thinly coating the surfaces of the minute balls with resin; allowing them to be trapped in a plate of hydrous polyvinyl alcohol resin and then evaporating a moisture component for solidification. Thereafter, the plate is impregnated with an organic solvent to dissolve the resin on the surface of the minute ball, thereby forming a gap between the ball surface and the polyvinyl alcohol resin plate. Thereafter, this plate is sandwiched between the glass substrates and fill liquid between the substrates. In this method, the plate of the polyvinyl alcohol resin absorbs the liquid, and as a result, the gap between the ball and the plate is filled with the liquid.

However, in the above-mentioned manufacturing method, it takes much time and effort to coat the minute balls with resin, and furthermore, it is difficult to control the distributed density of the minute balls in the resin with high accuracy. Furthermore, since the plate material is sandwiched between the glass substrates, there is a limitation on reducing a space between the electrodes. Thus, it is difficult to increase an electric field applied to the minute balls. As a result, the rotation speed of the minute balls becomes small, reducing the response speed of images.

Furthermore, if materials have largely different refractive indexes, reflection occurs on the interface between the materials and a double image, etc. occurs, which may lead to an inferior viewability of images.

SUMMARY OF THE INVENTION

With the foregoing in mind, it is an object of the present invention to provide a display device using ball-shaped or cylinder-shaped pixels having a large dipole moment and having a high response speed, a method for manufacturing such a display device and a method capable of arranging the pixels simply and accurately.

In order to achieve the above-mentioned object, the display device of the present invention includes a plurality of charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film; and each of the two regions accounts for 40% or more and 60% or less of the surface area of the base material; and wherein the plurality of charged substances are dipped in liquid between a pair of substrates each having an electrode, and voltage is applied to the electrodes, thereby enabling the charged substances to be rotated.

Furthermore, in the display device of the present invention, it is preferable that at least one of the substrates is equipped with a color filter.

Furthermore, in the display device of the present invention, it is preferable that the organic film is a monomolecular film. It is preferable that the film thickness of the organic film is 100 nm or less. An example of the organic film includes a fluorine film.

Furthermore, in the display device of the present invention, it is preferable that the base material of the charged substance has a sphere shape or a cylinder shape. The shape of the base material is not particularly limited to the above-mentioned shapes as long as it has a curved surface and is rotatable around a predetermined axis. Furthermore, as a material, glass, ceramic material, or the like may be employed in addition to metal.

Furthermore, in the display device of the present invention, it is preferable that the liquid has a high resistance of $10^4$ Ω cm or more.

Furthermore, in the display device of the present invention, it is preferable that the organic film includes adsorbed water or adsorbs water containing electrolytes and is in contact with the high resistance liquid.

Furthermore, it is preferable that water is adsorbed with a surfactant and the surfactant has both cationic property and anionic property.

Furthermore, in the display device of the present invention, it is preferable that the difference between the refractive index of the transparent substrate located in a light path where light enters, passes through and is reflected from and the refractive index of the liquid is 0.1 or less.

Furthermore, in the display device of the present invention, it is preferable that the film thickness of the electrode has an odd multiple of one-half the light wavelength.

Furthermore, in the display device of the present invention, it is preferable that each of the charged substances functions as a pixel and each pixel is provided with at least one lens, or that the lens is provided on the substrate located at the side of a viewer.

Next, in order to solve the above-mentioned problem, the method for manufacturing the display device of the present invention uses charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounts for 40% or more and 60% or less of the surface area of the base material. The method includes: forming one or more of concave portions for disposing one or more of the charged substances in predetermined positions of an insulating substrate disposed between the electrodes; making the surface of the concave portions to be hydrophilic, the surface of the substrate other than the concave portions to be water-repellent and the surface of the charged substances to be hydrophilic; and disposing the charged substances in the concave portions by pouring a liquid containing the charged substances from one side to another of the substrate.

Next, in order to solve the above-mentioned problem, the method for manufacturing the display device of the present invention uses charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounts for 40% or more and 60% or less of the surface area of the base material. The method includes: forming one or more of concave portions for disposing one or more of the charged substances in predetermined positions of an insulating substrate disposed between the electrodes; making the surface of the concave portions to be hydrophilic, the surface of the substrate other than the concave portions to be water-repellent and the surface of the charged substances to be hydrophilic; and by pouring only liquid from one side to another of the substrate, thereby allowing the liquid to remain only in the concave portions, and then pouring the charged substances from one side to another of the substrate, thereby disposing the charged substances in the concave portions.

Next, in order to solve the above-mentioned problem, the method for manufacturing the display device of the present invention uses a plurality of charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounts for 40% or more and 60% or less of the surface area of the base material. The method includes: forming concave portions for containing the charged substances arranged in rows and columns on the glass substrate, exposing the glass surface on the concave portion and coating the portion other than the glass surface with a water-repellent organic film; on three masks corresponding to each color of red, green or blue and having grooves on the portions corresponding to the arrangement of colors, coating the portion other than the groove containing the charged substances with a water-repellent organic film and coating the wall surface of the groove with a hydrophilic organic film; flowing liquid from one side to another of one mask selected from the three masks, thereby allowing the liquid to remain in the grooves; spraying the charged substances to the selected mask to allow the charged substances to be taken into the liquid; approaching the glass substrate in which the liquid is allowed to remain in the concave portion to the groove provided on the selected mask, thereby fusing the liquid on the selected mask and the liquid on the glass substrate; allowing the charged substances to be contained in the concave portions of the glass substrate; and repeating the same processes with respect to the other masks, thereby arranging the charged substances corresponding to each color.

Furthermore, in the method for manufacturing the display device of the present invention, it is preferable that in fusing the liquid on the selected mask and the liquid on the glass substrate; the dry air is blown from one side of the selected mask or the selected mask is irradiated with heat to evaporate the liquid remaining in the grooves of the selected mask.

Furthermore, in the method for manufacturing the display device of the present invention, it is preferable that in fusing the liquid on the selected mask and the liquid on the glass substrate; the pressure of the dry air sent from one side of the selected mask is applied to fuse the liquid on the selected mask and the liquid on the glass substrate.

Furthermore, in the method for manufacturing the display device of the present invention, it is preferable that the three masks have convex portions corresponding to the concave portions for containing the charged substances in the glass substrate.

Furthermore, in the method for manufacturing the display device of the present invention, it is preferable that the static contact angle with respect to pure water on the water-repellent surface is 90 degrees or more and the static contact angle with respect to pure water on the hydrophilic surface is less than 90 degrees.

Furthermore, in the method for manufacturing the display device of the present invention, it is preferable that the static contact angle of the liquid used for pouring the charged substances is 60 degrees or more on the water-repellent surface and 50 degrees or less on the hydrophilic surface.

Furthermore, in the method for manufacturing the display device of the present invention, it is preferable that the liquid in which the charged substance is dipped or the liquid to be retained in the concave portion has a boiling point of 70° C. or more and less than 100° C.

Next, in order to solve the above-mentioned problem, the method for manufacturing the display device of the present invention uses charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounts for 40% or more and 60% or less of the surface area of the base material. The method includes: forming one or more concave portions used for disposing the charged substances in the insulating substrate; disposing the electrode so as to be in proximity of the concave portion; and pouring the liquid containing the charged substances to the concave portions in a state in which AC electric field is applied by the use of the electrode, thereby disposing the charged substances in the convex portions.

Next, in order to solve the above-mentioned problem, the method for manufacturing the display device of the present invention uses a plurality of charged substances having a volume of less than 1 $cm^3$ in different charged states or with opposite polarities in two regions of a surface area of a base material, wherein an organic film is bonded and fixed to a part of or an entire surface of the base material via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; the surface region of the base material is divided into two regions in accordance with the kind of organic films or the presence or absence of the organic film, and each of the two regions accounts for 40% or more and 60% or less of the surface area of the base material. The method includes at least: filling the charged substances in a nozzle and mixing the charged substances and a paste in the vicinity of an outlet port for ejecting the discharged substances from the nozzle, and arranging the charged substances in rows and columns on the substrate.

Next, in order to solve the above-mentioned problem, the method for manufacturing the display device of the present invention at least includes: coloring a half part of a fiber whose cross sectional shape is circular; forming an organic film bonded and fixed to the surface of the fiber via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate; forming a sacrificial film on the organic film; arranging both the fiber provided with the sacrificial film and a transparent filler on a substrate at predetermined intervals; solidifying the filler; cutting the arranged film into a predetermined length; and removing the sacrificial film; wherein the surface region of the fiber, which is cut into a predetermined length in accordance with the kind of organic films or the presence or absence of the organic film; each of the two regions accounts for 40% or more and 60% or less of the total surface area with respect to the fiber cut in to the predetermined length; and the two regions are in different charged states or have different polarities.

Next, in order to solve the above-mentioned problem, the method for manufacturing the display device of the present invention at least includes: disposing a fiber having a circular cross section and provided with an organic film bonded and fixed to a surface thereof via —A—O— bond, where A denotes Si, Ge, Sn, Ti or Zr, or via —A—N— bond, where A denotes Si, Ge, Sn, Ti or Zr, in the former, the side of O is bonded to the substrate and in the latter, the side of N is bonded to the substrate, and on the substrate together with a filler at predetermined intervals; solidifying the filler; polishing or grinding the fiber to form into a half-cylinder shaped fiber; forming a white film on the surface of the half-cylinder shaped fiber; forming a film colored with any one of colors selected from cyan, magenta, and yellow on the surface of the white film; laminating a transparent film having a predetermined thickness on the surface of the half-cylinder surface; heating the transparent film to cause it to take a semicircular shape and thereby form a cylinder-shaped fiber; and cutting the cylinder-shaped fiber into a predetermined length.

Next, in order to solve the above-mentioned problem, the method for manufacturing the display device of the present invention includes: forming a multilayer film by sequentially adhering a first transparent film, a second film having a front surface of any one color from cyan, magenta, and yellow, and a rear surface of white, and a third transparent film of having the same thickness as the first film; drawing a fiber that is cut so as to have a quadrangle cross section from the heated nozzle, molding the cross sectional shape to be circular, and further forming an organic film bonded and fixed to the surface of the fiber via —A—O— bond, where A denotes Si, Ge, Sn, Ti or Zr, or via —A—N— bond, where A denotes Si, Ge, Sn, Ti or Zr on the surface, in the former, the side of O is bonded to the substrate and in the latter, the side of N is bonded to the substrate; forming a sacrificial film on the organic film, disposing the fiber in a state in which the sacrificial film is formed on the substrate with a transparent filler at predetermined intervals, solidifying the filler; cutting the fiber in a predetermined length; and removing the sacrificial film.

DESCRIPTION OF THE PREFERRED EMBODIMENTS

Figure 1:
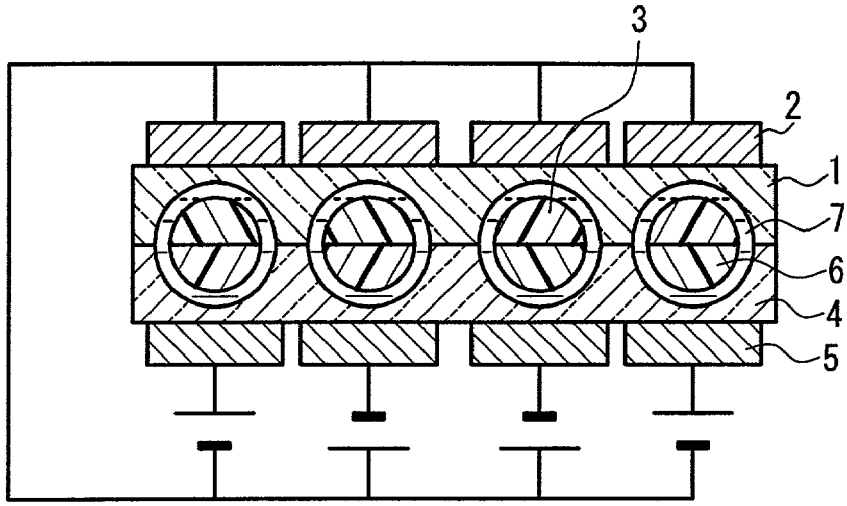
FIG. 1 is a sectional view showing a configuration of a display device according to the present invention.

The display device according to the present invention includes, for example, the following two embodiments.

(1) A display device characterized in that: a half surface of a ball-shaped or cylinder-shaped pixel is colored; an organic molecular film is formed on the surface of the pixel; the surface of the pixel is divided into two regions in accordance with the kind of organic molecular film or the presence or absence of the organic molecular film, so that the colored region and the other region are in different charged states; the pixels are arranged between the pair of substrates each having an electrode in a state in which the pixels are dipped in liquid and at least one side of the substrate and the electrodes where light passes through is transparent; and voltage is applied to the electrodes, thereby rotating the pixels.

(2) A display device characterized in that: a ball-shaped or cylinder-shaped pixel having a colored smooth base material in its cross section including its diameter is formed; an organic molecular film is formed on the pixel; the surface of the pixel is divided into two regions in accordance with the kind of organic film or the presence or absence of the organic molecular film, so that the surface region of the pixel at the side of the vertical projection surface of the colored smooth base material and the surface region of the other portion are in different charged states; the pixels are dipped in liquid; the pixels are arranged between the pair of substrates each having an electrode where light passes through and at least one side of the substrate and the electrodes where light passes through is transparent; and voltage is applied to the electrodes, thereby rotating the pixels.

According to the display device of the present invention having such a configuration, in accordance with the direction of the electric field by the electrode, it is possible to orient the colored surface of the ball-shaped or cylinder shaped pixels upward or downward freely.

In the display device of this embodiment, if one half of the pixel and another half of the pixel are in different charged states, by applying an electric field to the pixel from the outside, the pixel can be rotated. It is possible to provide the different charges by forming organic molecular films having different charges on one half of the pixel and another half of the pixel, or by forming an organic molecular film having charges only on the half surface of the pixel. In the latter case, the surface of the pixel on which the organic molecular film is not formed is required to have charges different from those on the organic molecular film. In particular, when the charges on one half side and another half side have the same absolute value and opposite signs, the pixel has an electric dipole as a whole, and the pixel can be rotated efficiently even with a small electric field.

Furthermore, as to the region distribution when the surface region of the base material is preferably divided into two regions in accordance with the kind of organic films or the presence or absence of the organic film, it is preferable that each region accounts for 50%. However, it is practically sufficient that the region can be divided into two regions so that each region accounts for 40% or more and 60% or less.

The surface of the pixel or organic molecular film can obtain charges as it is brought into contact with liquid. For example, when materials for forming the pixel are glass, the surface of the pixel is charged negatively due to the electrolytic dissociation of a silanol group in a neutral aqueous solution. Furthermore, for example, an organic film having a functional group such as a quaternary ammonium ion is charged positively in a neutral aqueous solution.

By forming a predetermined organic molecular film on the pixel, regardless of the kinds of substrates, it is possible to provide a large density of charges of the organic molecular film. Thus, it is possible to provide a distribution of charges necessary to the rotation of the pixel. Since the charges on the surface of the substrate are not generated before the substrate is brought into contact with liquid, when an organic molecular film is formed on the surface of the substrate, even if the substrate is exposed to liquid, the liquid cannot be present in the interface between the substrate and the organic molecular film, and the electric surface on the surface of the substrate is marked. Then, when a film of an organic molecule having a functional group capable of being dissociated in a neutral solution is formed on the surface of the ball-shaped or cylinder-shaped pixel, as compared with the case where a chalcogen-based inorganic material is coated, the ball-shaped or cylinder-shaped pixel can be provided with a much larger dipole moment.

It is preferable that the film thickness of the organic molecular film for providing the pixel with a predetermined charge is 100 nm or less. In order to do so, the organic molecular film is preferably a monomolecular film. Since the film thickness is 100 nm or less, visible light hardly is absorbed, and the color of the substrate can be kept. Therefore, even if the monomolecular film is formed after the minute ball or cylinder is colored with an arbitrary color, the color of the substrate is kept.

Furthermore, the surface charge of the minute ball or cylinder can be set arbitrarily by changing the kind or density of the organic molecular film. Furthermore, when the organic molecular film is a monomolecular film, in a case where a molecular end of the opposite side where the monomolecular film is not bonded to the substrate has charges, or has charges by the electrolytic dissociation in liquid, the monomolecular film is oriented in the predetermined direction. Consequently, the charge density becomes higher than that of the polymer film.

In general, an organic molecular film can be formed by various methods described in, for example, "Guide to Organic Ultra Thin Film" (written by Akira Yabe, published by Baifukan, p.123 (1998)). Examples of forming methods include a Langmuir-Blodgett technique of scooping a monomolecular film formed on a water surface to a substrate; a rotational coating method including steps of providing a substrate on a rotating base, dropping a film-forming solution onto the substrate, drying the base while rotating the substrate, and thinning the film; a casting method including steps of coating a solution onto the entire surface of a substrate, followed by air-drying the solution so as to thin the film; an on-the-water extending method for drying a solution on the water so as to thin a film; an electrolytic polymerization method for forming a polymer film on a surface of a conductive substrate by electrolysis; an anodic oxidation method for precipitating an oxide film by electrolysis; a vacuum deposition method for depositing a film on a substrate by heating and evaporating a film component in vacuum; an MBE method for forming a film by using a molecular beam in ultra-high vacuum; a cluster ion beam method for forming a film by the use of ionized molecule clusters; an ion beam vapor deposition method carrying out the ion irradiation of an inert gas and the vapor deposition; a high frequency ion plating method for forming a film by the use of accelerated ions; a sputtering method for sputtering a film forming particles by the use of ionized atoms to allow them to be deposited on a substrate; a chemical vapor deposition (CVD) method for forming a film through a chemical reaction in a gas phase; a heat CVD method or an optical CVD method for carrying out the chemical reaction by heat or light; a plasma polymerization method for forming a film by the reaction of ions or radicals generated under high frequency, and the like. Among the above-mentioned methods, the CVD method and the plasma polymerization method are referred to as a chemical film formation method.

In addition to the above-mentioned methods, a chemisorption method also is known (K. Ogawa et al. Langmuir, 6, 851 (1990)). This method is effective in forming a monomolecular film.

The most preferable method for forming an organic molecular film in the display device according to the present invention is a method for manufacturing an organic ultra thin film, which is disclosed in JP10 (1998)-175267A.

The following is an explanation of the method for forming an organic molecular film with charges. In the case where the organic molecular film is a monomolecular film, a substrate is dipped and reacted in a solvent containing a silane coupling agent (an agent having, on the end group of molecule, a functional group for forming a chemical bond by reacting with active hydrogen, such as a chlorosilyl group, an alkoxysilyl group, etc.) and then the substrate is taken out and washed with an organic solvent. In such a formed organic molecular film, the end group of the molecules on the side opposite to the substrate is transformed into a chemical structure having charges by electrolytic dissociation in a liquid.

For example, in order to form a monomolecular film with negative charges on a base material, the following method may be employed. As a material for forming a monomolecular film, 10-(carbomethoxy) decyltrichlorosilane is used so as to form a monomolecular film on a predetermined substrate. In other words, after dipping and reacting the substrate in a solution containing 10-(carbomethoxy) decyltrichlorosilane, the substrate is taken out and washed with chloroform.

Thereafter, this monomolecular film is subjected to hydrolysis so as to transform an ester group into a carboxyl group and the carboxyl group of the monomolecular film is transformed into an anion by adjusting the pH. The hydrolysis may be carried out by treating the substrate with boiling dilute sulfuric acid. Thus, it is possible to provide the surface of the monomolecular film with negative charges.

Furthermore, as another method, for example, 16-bromohexadecyl trichlorosilane ($Br(CH_2)_{16}SiCl_3$) is formed on a predetermined pixel in a form of a monomolecular film, Br is substituted by SCN with a NaSCN agent by a nucleophilic substitution reaction, followed by reducing to SH with $LiAlH_4$, and finally it is reacted with a hydrogen peroxide solution so as to form $SO_3H$ (N. Balachander et al. Langmir, vol. 6, p1621, 1990). By exposing this pixel to an aqueous solution, the monomolecular film is charged with negative charge ($SO_3^-$).

Furthermore, for example, in order to provide a monomolecular film with positive charges, the following method may be employed. For example, 16-bromohexadecyl trichlorosilane ($Br(CH_2)_{16}SiCl_3$) is formed on a predetermined pixel, Br is substituted by $N_3$ with a $NaN_3$ agent by a nucleophilic substitution reaction, followed by reducing with $LiAlH_4$ to obtain $NH_2$ (N. Balachander et al. Langmir, vol. 6, p1621, 1990). By exposing this pixel to an aqueous solution, the monomolecular film is charged with positive charge ($NH_3^+$).

Furthermore, as a material for forming a monomolecular film, N-trimethoxypropyl-N,N,N-trimethylammonium chloride may be used to form a monomolecular film on a predetermined pixel. This film material has a form of ammonium chloride and has a cation ammonium group. Therefore, the surface of the monomolecular film is provided with a positive charges.

Furthermore, for example, a monomolecular film is formed by the use of 3-aminopropyltrimethoxysilane and the surface of the resultant monomolecular film is brought into contact with an aqueous solution of hydrogen chloride, and thus $NH_3^+$ can be formed on the surface of the monomolecular film.

It is possible to form a monomolecular film having a nitric acid ion, a sulfuric acid ion, etc. in addition to an acetic acid ion, an ammonium ion, mentioned above.

Furthermore, in the case where the organic molecular film is not a monomolecular film, a pixel may be dipped and reacted in a reaction solution containing a silane coupling agent, and thereafter taken out and dried without washing, or a reaction solution may be coated on the pixel by a spin coat method or a cast method and dried. Thereafter, similar to the method for forming a monomolecular film, a chemical structure may be changed optionally so that the formed organic molecular film is electrolytic-dissociated in a solution so as to have charges.

In the display device according to the present invention, a material for forming a ball-shaped or cylinder shaped pixel is not particularly limited as long as it is a transparent solid capable of accepting an organic molecular film on the surface. Examples of such materials include ceramic, plastic, glass, in particular, quartz, sapphire, metal oxide with an excellent light transmittance such as MgO, and the like.

Furthermore, it is preferable that the diameter of the ball-shaped or cylinder-shaped pixel is 200 $\mu$m or less. From the viewpoint of improving the resolution of the pixel, the diameter of the pixel is preferably 200 $\mu$m or less. On the other hand, from the viewpoint of easiness for the surface treatment, a diameter of the pixel is preferably 1 $\mu$m or more.

As a coloring agent for coloring a half part of the ball-shaped or cylinder-shaped pixel used for the display device according to the present invention, in the case where the material for forming the ball-shaped or cylinder-shaped pixel is an inorganic material such as ceramic, glass, in particular, quartz, sapphire, a metal oxide with an excellent light transmittance such as MgO, and the like, a glass thin film to be colored may be formed on the surface of the pixel. In the case where a $Na_2O$—$SiO_2$ glass thin film is used, various ions in accordance with colors (for example, red: $Mn^{2+}$, $Fe^{2+}$, green: $Cr^{3+}$, $V^{3+}$, blue: $Cu^{2+}$, $Co^{2+}$, $V^{4+}$, etc) may be added. Since these ions work as a network-modifier ion or a network-former ion in a glass thin film, the glass thin film is colored.

In the case where the material for forming the ball-shaped or cylinder-shaped pixel is plastic, pigment of organic material may be formed on the surface. Various kinds of pigments can be used in accordance with colors (for example, red: chromophthal red, green: phthalocyanine green, blue: phthalocyanine blue, etc).

A method for coloring a half surface of the ball-shaped or a cylinder shaped pixel used for a display device according to the present invention includes: allowing a pixel to stand still and setting it in a vacuum device to thus form a pigment on only the upper half of the pixel by an EB vapor deposition method. For this vapor deposition, it is necessary to dispose the evaporation source on the upper portion of the glass plate on which the pixel is allowed to stand still, and to increase the vacuum degree at the time of vapor deposition to be as high as possible in order to prevent the pigment from entering the rear bottom surface of the pixel. Furthermore, in the case where the dyestuff is evaporated, in order to prevent the thermal deterioration of the dyestuff, the dyestuff is preferably evaporated by heating with a heater.

Furthermore, as another method, the pixel is set on a smooth surface such as a glass plate, etc.; a resist film is formed on the upper half of the pixel by a spray coating method; then the resist film is heated and cured; thereafter this pixel is dipped in a solution containing the dyestuff so as to color this pixel, and then the resist film is peeled off.

A material for forming a pair of substrates 1 used for the structure of the present invention is not particularly limited as long as it is a solid capable of accepting an organic molecular film on its surface. Examples of such materials include ceramic, plastic, glass, in particular, quartz, sapphire, metal oxide such as MgO, and the like.

A method for producing a cylinder-shaped fiber as a material forming a specific cylinder-shaped pixel includes a method shown in FIG. 18. In FIG. 18A, first, a sheet in which some plastic fibers were inserted is prepared. However, as a solution for forming the sheet, tetraethoxysilane ($Si(OC_2H_5)_4$), water, 36 vol % aqueous solution of hydrochloric acid, mixed solution of ethanol, instead of PVA, may be used. The mixing ratio of each material in solution is 30:5:0.2:70 in volume ratio. After the mixing solution is applied, an entire sheet is fired at 100° C. for 12 hours. Thus, a sheet in which the fibers were inserted in the glass ($SiO_2$) can be formed.

Figure 18A:
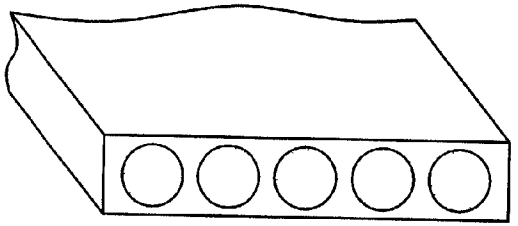
FIGS. 18A to 18F are perspective views showing steps for manufacturing a cylinder-shaped fiber according to the present invention.
Figure 18B:
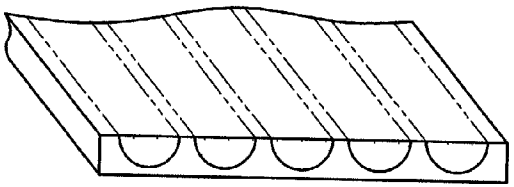
Figure 18C:
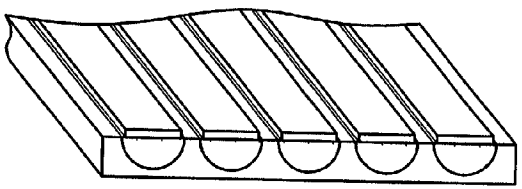
Figure 18D:
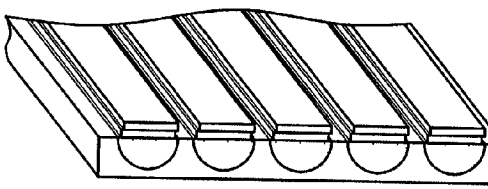

Next, as shown in FIG. 18B, a half part of the sheet is polished. Then, as shown in FIG. 18C, a pattern of white films is formed on a half part of the fibers. Furthermore, as shown in FIG. 18D, a pattern of a red, green, or blue films are formed on the white films.

Figure 18E:
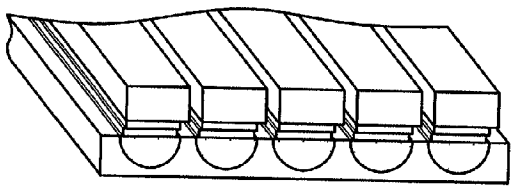
Figure 18F:
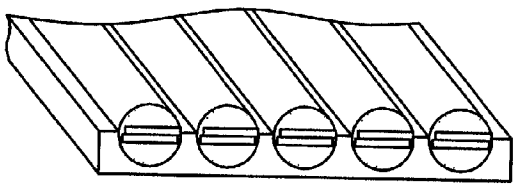

Next, as shown in FIG. 18E, a pattern of a polymethacrylate thin film is formed on the half part of the fibers. Then, this sheet is fired at 200° C. for 10 minutes, and thus plastic films are melted and a half-cylinder shape is formed on each fiber. As a result, a structure in which both sides of the equatorial plane are colored and only half part is protruded from the glass sheet can be formed.

Next, on a part of the fibers protruded from the sheet, a monomolecular film having an amino group on its end group is formed. As a result, on the part of the fibers that is inserted in the glass sheet, monomolecular films having positive charges are formed, and on the part of each fiber protruded from the sheet, a monomolecular film having negative charges is formed. A resist film is formed on the surface of the sheet so as to protect the protruded surface of the fiber.

Next, by cutting this sheet, a structure is formed in which a half part of the cylinder-shaped fiber having a diameter of 10 $\mu$m and a length of 100 $\mu$m is protruded from the glass sheet. Then, the fiber is dipped in a 1N solution of sodium hydroxide at 80° C. for 5 hours to remove the glass sheet. Furthermore, the fiber is dipped in a resist peeling solution so as to remove the resist on the surface of the fiber. Thus, it is possible to form a cylinder-shaped fiber having a diameter of 10 $\mu$m and a length of 100 $\mu$m and having one half surface that is charged positively and another half surface that is charged negatively.

The formed cylinder-shaped fibers according to the above described method are used and a display main body is formed.

Furthermore, a method shown in FIG. 19 may be employed. In FIG. 19A, a sheet, which is made of polymethyl methacrylate and has a thickness of 5 $\mu$m and a size of 20 mm×20 mm, is prepared and a white film is formed on a half surface of the polymethyl methacrylate sheet, followed by forming a red or green film thereon (FIG. 19B).

Figure 19A:
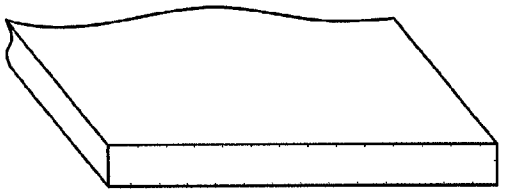
FIGS. 19A to 19E are perspective views showing steps for manufacturing a cylinder-shaped fiber according to the present invention.
Figure 19B:
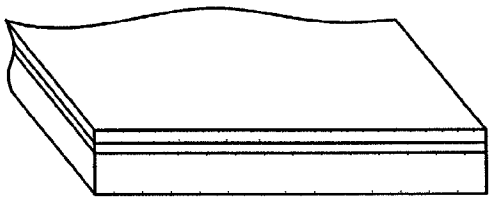
Figure 19C:
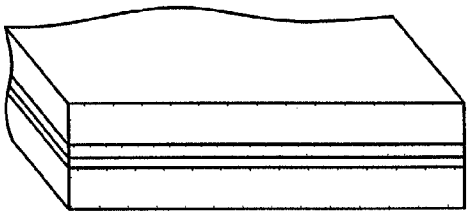
Figure 19D:
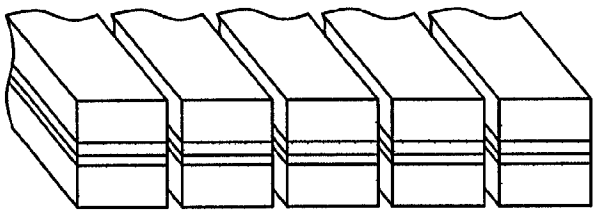
Figure 19E:
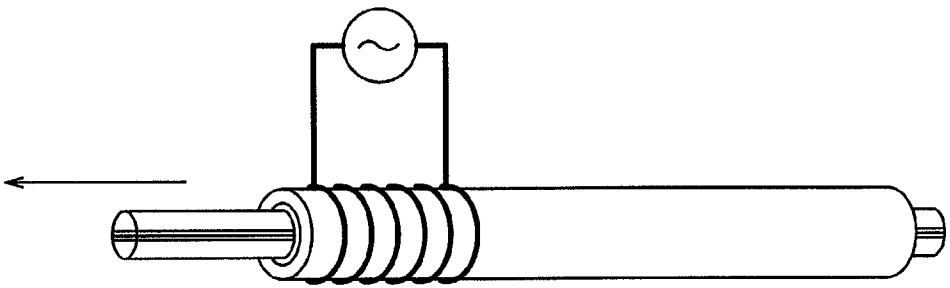

Next, as shown in FIG. 19C, a sheet having a thickness of 5 $\mu$m and a size of 20 mm×200 mm is laminated thereon and heated at 200° C. for 5 minutes to fuse the two sheets. Then, on surface of the sheet is protected by coating resist, and thereafter, a monomolecular film having a carboxyl group as an end group is formed. Thereafter, the resist is peeled off and a monomolecular film having an amino group on end group is formed on another surface. Then, as shown in FIG. 19D, this sheet is cut in a width of 15 μm and formed into a prism of 15 μm×15 μm×20 mm.

The formed prisms are put into a stainless steel nozzle having an inner diameter of 20 μm and a length of 15 mm. The cross-sectional shape of the inside the nozzle is changed from a square shape to a circular shape toward the tip of the nozzle. The prisms are pushed into the nozzle slowly while heating the tip of the nozzle at 200° C. Thus, the cut sheet having a prism shape at an insertion port of the nozzle is changed into a cylinder shape at the outlet port due to heating in the vicinity of the nozzle tip portion. Therefore, the sheet ejected from the nozzle has a cylinderical shape.

The main body of the display device is formed by the use of the thus formed fibers.

It is preferable that the ball-shaped or cylinder shaped pixels having an organic molecular film on the surface thereof are dipped in liquid with high resistance (high resistance liquid) and that the intensity of electric field obtained by the voltage applied between the electrodes is uniform between the electrodes and the rotation speed of the display device is high.

In the display device of this embodiment, it is preferable that the pixels on which the organic molecular film is formed on the surface are dipped liquid with a resistance of $10^4$ Ω cm or more. Thus, the voltage applied between the electrodes sandwiching each pixel acts as an outer electric field with respect to each pixel without being electrostatically shielded by liquid. An example of such a liquid includes an aqueous solution or organic solution containing 1 mmol/L or less of electrolytes.

In the case where the liquid is an aqueous solution, as the electrolyte, a neutral salt such as NaCl, KCl, etc. can be employed. The pH of the electrolyte is preferably 5 to 9, and more preferably 7 or less, taking into account the lifetime, since the monomolecular film is destroyed by alkaline. The conditions for measuring the pH of the electrolyte is a 25° C. aqueous solution having a concentration of the targeted electrolyte of 1 mmol/L.

In the case where the liquid is an organic solution, as a solvent, acetic anhydride, methanol, tetrahydrofuran, propylene carbonate, nitromethane, acetonitrile, dimethylformamide, dimethylsulfoxide, hexamethylphosphoamide, can be used. As an electrolyte, $NaClO_4$, $LiClO_4$, KOH, $KOCH_3$, $NaOCH_3$, LiCl, $NH_4Cl$, n-$(CH_3C_3H_6)_4N$, $Mg(ClO_4)_2$, $NaBF_4$ and the like, can be used.

Furthermore, it is preferable that the high resistance liquid such as an alcohol-based solvent, various esters, aliphatic hydrocarbon, alicyclic hydrocarbon, aromatic hydrocarbon, halogenated hydrocarbon, and other various kinds of oil contains a small amount of water. It is advantageous because, when the pixel is brought into contact with such a liquid, adsorbed water can be attached to the surface of the pixel, and thus the amount of charges can be adjusted.

Furthermore, it is preferable that an alcohol-based solvent, various esters, aliphatic hydrocarbon, alicyclic hydrocarbon, aromatic hydrocarbon, halogenated hydrocarbon, and other various kinds of oil contain a charge control agent such as surfactant, a metallic soap, resin, rubber, oil, and the like, and a small amount of water. It is advantageous because, when the pixel is brought into contact with such a liquid, adsorbed water and surfactant are attached to the surface of the pixel, and thus the amount of charges on the surface of the pixel can be adjusted.

Furthermore, in the display device of the embodiment of the present invention, it is preferable that the adsorbed water is adsorbed on the surface of the pixel and the pixel is dipped in a high resistance liquid with $10^4$ Ω cm or more; or that a water containing electrolyte is adsorbed on the surface of the pixel and the pixel is dipped in a high resistance liquid with $10^4$ Ω cm or more. Thus, the electrolysis of the organic molecular film on the surface of the pixel is promoted due to ions in the adsorbed water on the surface of the pixel and the amount of charges on the surface of the pixel can be adjusted.

Furthermore, in the display device of the embodiment of the present invention, it is preferable that the adsorbed water and surfactant are adsorbed on the surface of the pixel and the pixel is dipped in a high resistance liquid with $10^4$ Ω cm or more. Thus, due to the adsorbed water and surfactant on the surface of the pixel, the amount of charges on the surface of the pixel can be adjusted.

As the surfactant, an amphoeric surfactant, for example, a carboxy betaine type lauryldimethyl betaine acetate, or a glycine type 2-undecyl-N-carbosymethy-N-hydroxyethyl imidazolinium betaine, is preferable. These surfactants are bonded to the adsorbed water on the surface of the pixel and release positive and negative ions into the adsorbed water to promote the electrolytic dissociation of the organic molecular film on the surface of the pixel. Then, based on the difference in the number of molecules between in the surfactant in the adsorbed water and the organic molecular film on the surface of the pixel, the amount of charges generated on the surface of the pixel is controlled.

Furthermore, in the display device of the embodiment according to the present invention, in the substrate and the electrode, which are members for sandwiching the pixels, at least one side of the substrate and the electrode is transparent. That is, it is preferable that the substrate and electrode at the side through which light passes is transparent. The substrate and electrode at the side through which the light does not pass may be transparent or may not be transparent. With such a configuration, the light transmittance can be secured in the display device. In order to increase the response speed of the pixels, the distance between the electrodes can be minimized as short as possible.

Furthermore, in the display device of the embodiment according to the present invention, the display efficiency is enhanced when pixels are fixed to a predetermined place rather than the case where the pixels are dispersed at random. Accordingly, in the display device of the present invention, a transparent insulating substrate is sandwiched between the electrodes, this substrate is provided with the concave portions for containing pixels, and in each concave portion, one pixel is contained together with liquid. For allotting each pixel to the concave portion, the method of the present invention is used.

The above-mentioned methods are only one part of the usable methods. Needless to say, the method is different depending upon the material to be used. In this case, any usual chemical method can be employed.

Furthermore, the present invention provides a method for manufacturing a display device. Specific examples includes the following seven methods.

(1) A method for manufacturing a display device including: forming one or more concave portions for disposing one or more of the pixels in a predetermined position of an insulating substrate disposed between the electrodes; making the surface of the concave portions to be hydrophilic, the surface of the substrate other than the concave portions to be water-repellent and the surface of the pixel to be hydrophilic; and disposing the pixels in the concave portions by pouring a liquid containing the pixels from one side to another of the substrate. This method utilizes the fact that it is difficult for liquid to remain on a surface other than the concave portions of the substrate because the liquid is repelled from the surface, while the surface of the concave portions has an excellent wettability and liquid can remain thereon.

Furthermore, in the embodiment of the present invention, pixels can be disposed in the predetermined positions by using only the liquid, instead of the liquid containing pixels. In this case, only the liquid is poured from one side to another of the substrate, thereby allowing the liquid to remain only in the concave portions, and then by pouring the pixels from one side to another of the substrate, thereby disposing the pixels in the concave portions.

This method utilizes the fact that it is difficult for liquid to remain on a surface other than the concave portions of the substrate because the liquid is repelled from the surface, while the surface of the concave portions has an excellent wettability and liquid can remain thereon. When the liquid remains in the concave portions, the minute balls or cylinders having a surface with excellent wettability with respect to the liquid are brought into contact with the liquid present in the concave portions and the minute balls or cylinders are drawn to the concave portions with the surface tension of the liquid.

(2) A method for manufacturing the display device which is a method for disposing three-color pixels, can be provided.

That is, a method for manufacturing a display device of the present invention includes forming concave portions for containing the charged substances arranged in rows and columns on the glass substrate, exposing the glass surface to be exposed on the concave portions and coating the portions other than the glass surface with a water-repellent organic film; on three masks corresponding to each color of red, green or blue and having grooves on the portions corresponding to the arrangement of colors, coating the portions other than the groove containing the charged substances with a water-repellent organic film and coating the wall surface of the groove with a hydrophilic organic film; pouring liquid from one side to another of one mask selected from the three masks, thereby allowing the liquid to remain in the grooves; spraying the charged substances to the selected mask to allow the charged substances to be taken into the liquid; causing the glass substrate in which the liquid for ionization is allowed to remain in the concave portions to approach the groove provided on the selected mask, thereby fusing the liquid on the selected mask and the liquid on the glass substrate; allowing the charged substances to be contained in the concave portions of the glass substrate; and repeating the same processes with respect to the other masks, thereby arranging the charged substances corresponding to each color. The method uses the water-repellent film.

In the method for manufacturing the display device according to the present invention, the liquid on the mask and the liquid on the glass substrate can be fused by the following three embodiments.

(i) An embodiment including: evaporating the liquid in the groove of the mask with dry air or heat ray sent from one side of the mask and allowing the pixels of the color to be contained in a groove of the substrate; and repeating the same process with respect to the other colors, thus arranging the pixels of each color.

(ii) An embodiment including: applying the pressure of the dry air sent from one side of the selected mask, thereby fusing the liquid on the selected mask and the liquid on the glass substrate.

(iii) An embodiment including steps of: pushing the liquid in the groove by the use of a mask having convex portions on the surface of the water-repellent surface corresponding to the concave portions for containing the pixels from one side of the mask so as to fuse and be contained in the groove on the substrate, and repeating the same process with respect to each color so as to arrange the pixels of each color.

The preferable example of the mask includes at least one selected from the group consisting of glass, silicon, silicon nitride and stainless steel.

As the organic molecular film having a water-repellent property used for the above-mentioned manufacturing methods (1) and (2), any one of $CH_3(CH_2)_nSiCl_3$ (n=0–20) and octadecyltrichlorosilane are preferred. Furthermore, the embodiment in which the above-mentioned aqueous solution is an organic solution and the water-repellent organic molecular film is any one of $CF_3(CF_2)_n(CH)_2SiCl_3$ (n=0–8) also is preferred.

Furthermore, it is preferable that the static contact angle with respect to pure water on the water-repellent surface is 90 degrees or more and the static contact angle with respect to pure water on the hydrophilic surface is less than 90 degrees. Thus, it is possible to form a portion in which the liquid can remain and a portion in which the liquid flows selectively.

Furthermore, it is preferable that the static contact angle of the liquid used for pouring the charged substance is 60 degrees or more on the water-repellent surface and the static contact angle is 50 degrees or less on the hydrophilic surface. Thus, it is possible to form a portion in which the liquid can remain and a portion in which the liquid flows selectively.

Furthermore, since it is necessary to remove the liquid after the pixels are arranged on the base material, the evaporation speed of the liquid is preferably as fast as possible. However, if the evaporation speed is too fast, while the pixels are being positioned, the liquid is evaporated and no liquid is left, thus making it difficult to position the pixels stably. The present inventors found that when the boiling point of the liquid is 70° C. or more and less than 100° C., pixels can be positioned stably.

(3) A method for manufacturing the display device, the method including: forming one or more concave portions used for disposing the charged substances in the insulating substrate; disposing the electrode so as to be in proximity of the concave portions; and pouring the liquid containing the charged substances to the concave portions in a state in which AC electric field is applied by the use of the electrode, thereby disposing the charged substances in the convex portions, in disposing the one or more ball-shaped or cylinder shaped pixels in the predetermined positions of the insulating substrate located between the electrodes.

In this method, with the AC electric filed generated in the vicinity of the concave portions, when a material constituting the pixel is a dielectric material, the pixel causes dielectric polarization, whereby the pixels are drawn statically to and disposed in the concave portions.

(4) A method for manufacturing the display device, including in disposing one or more of the ball-shaped or cylinder shaped pixels in the predetermined positions of the insulating substrate located between the electrodes, at least: filling the pixels in a nozzle and mixing the pixels and paste in the vicinity of an outlet port for ejecting the pixels from the nozzle, and arranging the pixels in rows and columns on the substrate.

(5) A method for manufacturing a display device, including in disposing one or more of pixels in the predetermined positions of the insulating substrate located between the electrodes, at least: coloring a half part of a fiber whose cross-sectional shape is circular; forming an organic film on the surface of the fiber; forming a sacrificial film on the organic film; arranging both the fiber provided with the sacrificial film and a transparent filler on a substrate at predetermined intervals; solidifying the filler; cutting the arranged film into a predetermined length; and removing the sacrificial film.

(6) A method for manufacturing the display device, including in forming pixels, at least: disposing fibers having a circular cross section on the substrate together with a filler at predetermined intervals; solidifying the filler; polishing or grinding the fibers to form a half-cylinder shaped fiber; forming a white film on the surface of a half-cylinder shaped fibers; forming a film colored with a color selected from cyan, yellow and magenta on the surface of the white films; laminating a transparent film having a predetermined thickness on the surface of the half-cylinder surface; heating the transparent films to roll in a semicircular shape to form a cylinder-shaped fibers; and cutting the cylinder-shaped fibers into a predetermined length.

(7) A method for manufacturing a display device, in forming pixels, including: forming a multilayer film by sequentially adhering a first transparent film, a second film having a front surface of any one color from cyan, yellow, and magenta, and a rear surface of white, and a third transparent film of having the same thickness as the first film; forming fibers that are cut so as to have a substantially square shaped cross section, and molding the cross sectional shape to be circular by being heated from the periphery with radiant heat.

Hereinafter, the present invention will be explained by way of embodiments, but the present invention is not limited by the below-mentioned embodiments.

First Embodiment

FIG. 1 is a sectional view showing an example of a configuration of a display device according to a first embodiment of the present invention. As shown in FIG. 1, the display device according to the first embodiment includes a pair of transparent substrates 1 and 4 made of glass, etc., which are disposed facing each other in proximity; a pair of transparent electrodes 2 and 5 formed on the outer surfaces; liquid 7 disposed between the transparent electrodes; and ball-shaped or cylinder-shaped pixels 3 whose half surface 6 is dipped in the liquid 7 and colored. Furthermore, if necessary, a reflector (not shown in the drawing) may be disposed between one of the substrates and the pixels. Furthermore, one of the substrates may be used as a reflector.

Furthermore, in the display device according to the first embodiment, the side through which light does not pass, that is, the substrate 4 and the electrode 5 in FIG. 1, need not be transparent. Furthermore, if necessary, for example, a 0.1 $\mu$m-thick reflector having a high reflectance and made of a thin film including MgO, ZrO, $SiO_2$, $Al_2O_3$, TiN, SiN, and the like, or a multi-layered film thereof may be disposed between the subtrate 4 and the pixels. Thereby, a bright display device can be provided.

Figure 2:
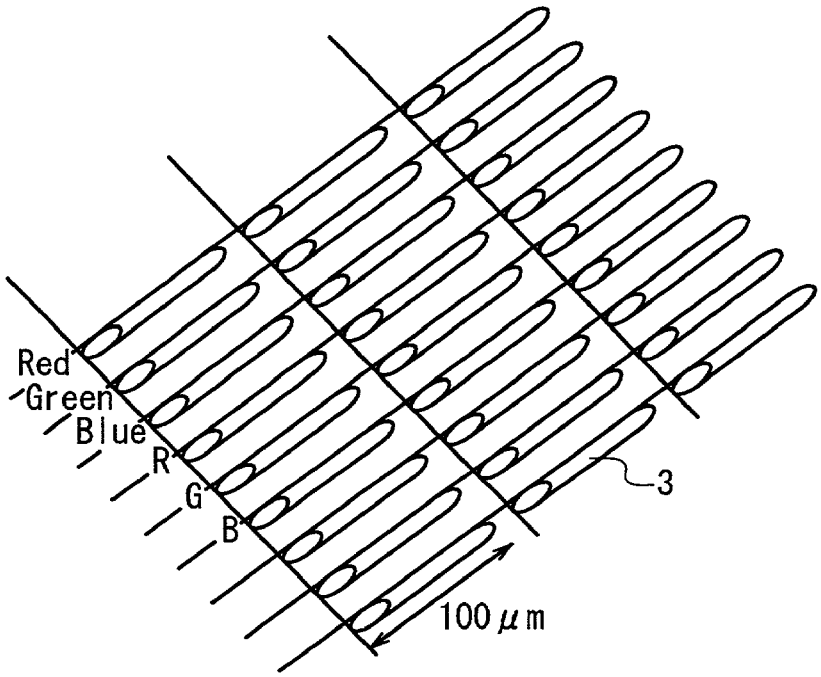
FIG. 2 is a view showing pixels arranged in a matrix shape used for the display device according to the present invention.

As shown in FIG. 2, ball-shaped or cylinder-shaped pixels are arranged in a matrix shape and designed so that letters and pictures are displayed in black-and-white or in colors. In the first embodiment, in the case where the pixels 3 have a cylinder shape as shown in FIG. 2, a diameter of the cylinder-shaped pixels is set to 30 $\mu$m and the length thereof is set to 200 $\mu$m, and three colors of red, green and blue are arranged as one group in rows and columns. An electrode is provided in each pixel 3 so that each pixel 3 operates independently. Furthermore, in the case where the pixels 3 have a ball shape, the diameter thereof is set to 30 $\mu$m, and three colors of red, green and blue are arranged as one group in rows and column.

FIG. 3 shows a relationship between the arrangement of the organic film formed on the pixel and the arrangement of the colored film. In FIG. 3, a colored film is applied to a half part of the glass surface of the ball-shaped or cylinder-shaped pixel.

Figure 3A:
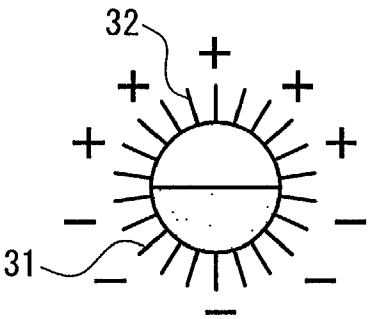
FIGS. 3A to 3D are views showing an organic film disposed in each pixel used for the display device according to the present invention.

First, in FIG. 3A, a monomolecular film 31 having negative charges on the colored film is formed on a half part of the glass surface and a monomolecular film 32 having positive charges is formed on another half part of the glass surface. As in this case, when the intensity of positive charge is substantially the same as the intensity of negative charge, it is possible to obtain the rotation power efficiently. However, the manufacturing process itself becomes complicated. In the following three arrangements, the step for forming a monomolecular film is formed on only one part, thus simplifying the manufacturing process and obtaining a large rotation power.

Figure 3B:
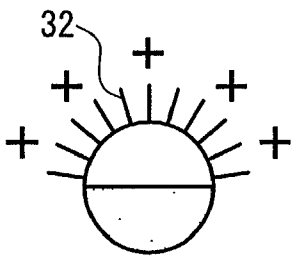

In FIG. 3B, a colored film is formed on the half part of the glass surface. The colored film does not generate charges. On another half part of the glass surface, the monomolecular film 32 having positive charges is formed. In this case, when only positive charges are provided, the intensity of the charge is reduced to half as compared with FIG. 3A. However, as compared with the prior art, a large amount of charges can be obtained.

Figure 3C:
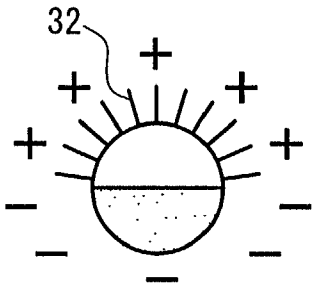

In FIG. 3C, a colored film is formed on the half part of the glass surface. The colored film generates charges and has negative charges. On another half part of the glass surface, the monomolecular film 32 having positive charges is formed. Thus, even if positive charge and negative charge are not eqiovalent, as compared with the prior art, a large amount of charges can be obtained. As a result, a large rotation power can be obtained.

Figure 3D:
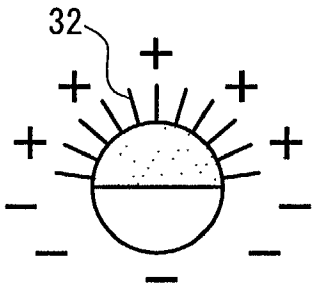

In FIG. 3D, a colored film is formed on the half part of the glass surface. When the colored film is a film that does not generate charges, the monomolecular film 32 having positive charges is formed. On another half part of the glass surface, the glass surface itself is dipped in an aqueous solution. The glass surface generates negative charges. Thus, even if positive charge and negative charge are not equivalent, as compared with the prior art, a large amount of charges can be obtained. As a result, a large rotation power can be obtained.

For a material for forming a transparent substrate 1 used for a structure of the display device according to the first embodiment, $Na_2O$—$SiO_2$ glass was selected.

FIG. 4 is a sectional view of a cell of one pixel and electrode, showing a relationship between the arrangement of electrodes and substrates. In FIG. 4A, a 150 $\mu$m-thick glass substrate was provided with a concave portion for containing a cylinder-shaped pixel having a diameter of 30 $\mu$m and a length of 200 $\mu$m. This was made to be a transparent substrate 1. Then, the transparent substrates 1 were arranged so that the concave portions thereof were facing each other. On one surface of the smooth substrate, a 0.2 $\mu$m-thick transparent electrode 2 was provided. On another surface of the smooth substrate, an electrode 2' was provided. In the case of the reflection type, the materials for the electrode have to be selected taking the reflectance or color into account. In the first embodiment, a 0.2 $\mu$m-thick copper electrode was provided as the electrode 2'.

In the case where the electrode 2 is made to be white, for example, alumina may be used. In this case, first, a metal aluminum is evaporated, followed by forming an oxide film of aluminum on the interface thereon. In the case of the metal aluminum electrode, the oxide film of aluminum is formed to 0.01 μm thick and metal aluminum is formed to 0.2 μm thick.

Furthermore, when black is needed, a transparent glass thin film having a refractive index that is different from that of the substrate is formed to a film thickness of one-half the light wavelength, or a glass thin film having a large light absorptance is formed. The glass thin film can be colored with ions. When the glass thin film is colored in black with ions, manganese, copper, iron, and cobalt are added to the glass thin film with high concentration. The thickness of the glass thin film may be about 0.1 μm. In this case, the intensity of light that passes through the glass is 10%. When the glass thin film is colored in blue, cobalt may be used. In the case of blue, a copper ion, and in the case of deep violet, manganese ion may be used.

In the first embodiment, a structure of the reflection type cell 1 is shown. The cylinder-shaped pixels of three colors of red, green and blue are formed in a longitudinal pitch of 40 μm and a lateral pitch of 210 μm.

Figure 4A:
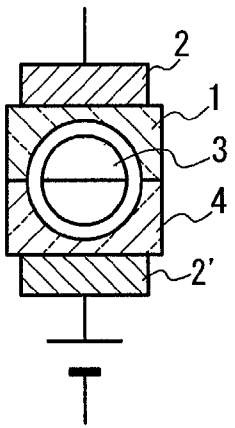
FIGS. 4A to 4G are sectional views showing a cell of a pixel and an electrode used for a display device according to a first embodiment of the present invention.
Figure 4B:
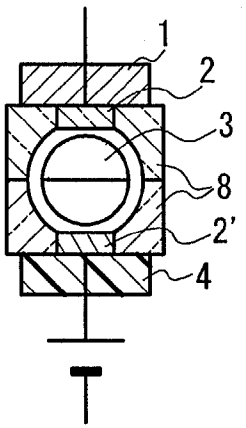

In FIG. 4B, a pair of 500 μm-thick transparent glass substrates (transparent substrates) 1 having transparent division walls 8 for containing a ball-shaped or cylinder-shaped pixel 3 are arranged facing each other. The transparent electrode 2 is disposed between the transparent division walls 8 and the transparent electrode 2 is provided on the surface of the transparent substrate 1. In this embodiment, a transparent electrode 2 having a thickness of 0.1 μm and a line width of 20 μm was formed. Similarly, on another substrate, a transparent division wall 8 and the electrode 2' are disposed. In the case of the reflection type device, the electrode 2' may not be transparent.

Figure 4C:
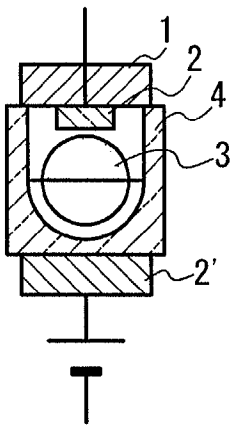

FIG. 4C shows a structure in which a ball-shaped or a cylinder-shaped pixel 3 is contained in one transparent substrate 1. The transparent substrate 4 is provided with a hemisphere concave portion and die-molded by using plastic, etc. as a material therefor. On a smooth portion of the smooth transparent substrate 1, an electrode 2' is formed. On the other hand, the transparent electrode 2 is disposed so that it covers the concave portion provided on the transparent substrate 4.

Figure 4D:
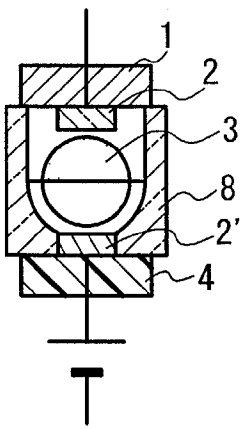

FIG. 4D shows a structure having a transparent substrate 4 for containing a ball-shaped or cylinder-shaped pixel 3 on one substrate 1. The transparent substrate 4 is formed on the substrate 1 and the electrode 2' is disposed between the transparent substrates 1 and 4. On the surface of another transparent substrate 1, a transparent substrate 2 is provided so that it covers the concave portion of the transparent division wall 8 having the concave portion. The above-mentioned A, B, C and D are of the reflective type and light is reflected by the electrode or substrate.

Figure 4E:
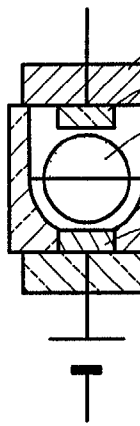

FIG. 4E has the same structure as in FIG. 4D, however, all the materials for forming the cell are transparent and light can transmit throughout the structure.

Figure 4F:
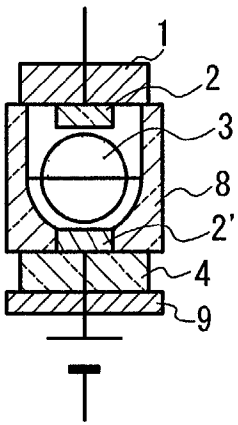

FIG. 4F has a structure in which a reflector 9 is attached to the transparent substrate 4. The structure of FIG. 4F is the same as the structure of FIG. 4E except that the reflector 9 is attached to the surface of the transparent substrate 4 on which the electrode 2' is not provided.

Figure 4G:
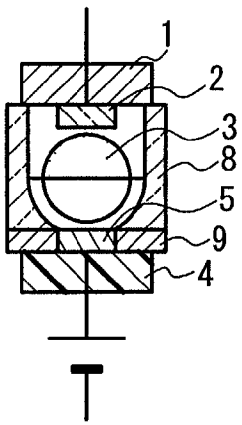

FIG. 4G has a structure in which the reflector 9 is attached to the peripheral portion of the transparent electrode 5. The transparent electrode 5 is formed on the surface of the transparent substrate and an insulating reflector 9 is attached thereon.

When the transparent electrode is in contact with liquid, electrolysis or electrode decomposition occurs on the surface of the transparent electrode. Therefore, if a monomolecular film or an ultra-thin organic molecular film is formed on the surface of the transparent electrode, when a volatile monomolecular film is formed on the surface of the electrode, in particular, in a case where the liquid contains aqueous solution or water, water is repelled from the surface of the electrode and liquid is not brought into direct contact with the electrode. Thus, it is possible to obtain a configuration free from electrolysis, electrode corrosion or the like.

In order to form an organic molecular film, which generates charges with opposite polarities by dissociation, onto the both half surfaces of the ball-shaped or cylinder-shaped pixels used for the display device according to the first embodiment, the following procedures were carried out. First, minute balls or cylinder-shaped pixels are allowed to stand still on a smooth glass plate and a resist film was coated from the upper part of the pixels by a spray coating method. With this method, resist films were formed only on the upper half portion of the pixels. Moreover, instead of coating a resist, chromium may be evaporated on the half surface of the pixels. In this case, a glass substrate in which pixels are allowed to stand still is put into an electron beam vapor-deposition device in which an evaporation source is provided on the upper surface with respect to the substrate, and chromium is evaporated. Thus, chromium is evaporated on only the upper half surface of the pixels. In the case where the resist films are coated on the pixels, the pixels were thermal-treated and hardened in the latter step.

Next, the pixels are disposed on a smooth glass substrate. The four edges of this glass substrate are provided with walls so that the pixels do not drop off from the substrate.

Then, the glass plate was disposed within an EB vapor-deposition device. In this device, the evaporation source is located in the upper part with respect to the substrate. Furthermore, the substrate was designed so as to oscillate at the frequency of 0.5 Hz. A pigment was used for the evaporation source. In other words, for coloring the pixel in red, chromophthal red pigment was used. For coloring in green, phthalocyanine green was used and for coloring in blue, phthalocyanine blue was used, respectively.

Next, the evaporation source was irradiated with electron beams while oscillating the substrate, thereby allowing the pigment to evaporate onto the pixels. Herein, since the substrate is oscillated, the pixels are rotated on the substrate and the pigment is evaporated over the entire surface of the pixels.

Then, the pixels were taken out from the unit, and a monomolecular film of 10-carbomethoxy dodecyltrichlorosilane ($CH_3$—O—$CO(CH_2)_{10}SiCl_3$)) was formed on the surface of each pixel. For the formation of this organic molecular film, the substrate (pixels) was dipped and reacted for one hour in a mixed solution of n-hexadecane/chloroform (80/20, v/v) in which 1 vol. % 10-(carbomethoxy) decyltrichlorosilane was dissolved. Then, the substrate was taken out and washed with chloroform. Thereafter, this monomolecular film was subjected to hydrolysis, thus transforming an ester group of the monomolecular film into a carboxyl group. This hydrolysis was carried out by dipping the substrate into 0.1% (v/v) boiling sulfuric acid for several minutes. Then, by adjusting the pH to neutral, the carboxyl group in the monomolecular film was transformed into an anion.

Next, the resist film on the pixels was peeled off. Accordingly, the pigment attached to the resist and the monomolecular film formed thereon were removed. As a result, the half surface of the pixels was colored, and the pixels on which the monomolecular film (HOOC—$(CH_2)_{10}$Si—) of a carboxyl group was formed on the colored portion were formed. In a case where chromium is evaporated instead of the resist, chromium may be etched with 80° C. $FeCl_3$ solution. Moreover, since the monomolecular film is resistant to the $FeCl_3$ solution, the monomolecular film is not destroyed during the process of etching the chromium.

Then, the pixels were dipped and reacted in an ethanol solution in which 1 vol. % 10-aminododecyl trimethoxysilane was dissolved, followed by filtering this solution with filter paper, and then the filter paper was washed in pure water. Thus, a monomolecular film ($NH_2$—$(CH_2)_{10}$Si—) having an amino group on its end group was formed on the half surface of the pixels not provided with the monomolecular film. As a result, pixels including a carboxyl group on one half surface and an amino group on another surface were formed. Moreover, a methoxy group (—$SiOCH_3$) of 10-aminododecyl methoxy silane was dehydration reacted with the carboxyl group (—COOH) to form C—O—Si bond. As a result, further organic molecular film was formed on the original monomolecular film to thus form ($NH_2(CH_2)_{10}$ Si—O—$CO(CH_2)_{10}$Si—). However, this bond was decomposed easily when exposed to water to return to the original carboxyl group. Therefore, as mentioned above, pixels including a carboxyl group and an amino group respectively on each half surface were formed.

The formed ball-shaped pixels were dipped in a high-resistance solvent and disposed between the facing surfaces of the pair of transparent electrodes on the pair of transparent electrodes. In a case where the display device according to the first embodiment utilizes reflected light, it is possible to dispose a reflector between the pixels and one of the electrodes or the substrates. In some cases, one of the substrates itself can be used as a reflector.

If the pixels move freely in liquid, the stability of the display device is deteriorated. In the preferable embodiment of the present invention, a transparent substrate is sandwiched between the pair of electrodes. The substrate is provided with one or more concave portions capable of containing one pixel and each pixel is disposed in a concave portion, thereby allowing the pixel dipped in liquid to contained in each concave portion. Thus, the free movement of each pixel can be limited.

It is preferable that each pixel is disposed in the concave portion of the transparent substrate by the method of the present invention. In other words, one or more concave portions capable of containing one pixel are formed on the substrate, the surface of the concave portion is made to be hydrophilic; the surface of the portion other than the concave portion is made to be water-repellent; and the surface of the ball-shaped or cylinder-shaped surface functioning as a pixel is hydrophilic. An aqueous solution of 10 $\mu$mol/L of KCl including these pixels is allowed to flow from one side to the other to dispose the pixel in the concave portion.

This method utilizes the fact that it is difficult for liquid to remain in a surface other than the concave portion of the substrate because the liquid is repelled from the surface, while the surface of the concave portion has an excellent wettability and liquid can remain thereon. When the liquid remains in the concave portion, the minute ball pixels or cylinder-shaped pixels having a surface with good wettability with respect to liquid are in contact with liquid that is present in the concave portion, and the minute balls or cylinders are drawn into the concave portion due to the surface tension of the liquid. In this process, the remaining KCl aqueous solution can be used as the liquid in which the pixels are dipped.

Hereinafter, the structure and the operation of the display device using cylinder-shaped pixels according to the first embodiment of the present invention will be explained with reference to FIG. 5. The structure according to the first embodiment shown in FIG. 5 is a schematic view showing a cell using a cross section shown in FIG. 4B. In FIG. 5A, a pair of 500 $\mu$m-thick transparent glass substrates are arranged with a 20 $\mu$m gap therebetween facing with each other. On the surface of the glass substrate, a 0.1 $\mu$m-thick transparent electrode 2 is formed. A transparent division wall provided with a concave portion having a diameter of 11 $\mu$m containing the cylinder-shaped pixel 3 having a diameter of 10 $\mu$m is formed on the transparent glass substrate. On the half surface of the cylinder-shaped pixel 3, a monomolecular film 33 having a negatively charged carboxyl group was formed. The surface charge density of the dissociated monomolecular film 33 was measured to be 0.2 $C/m^2$. On the other half surface, a monomolecular film 34 having a positively charged amino group was formed. The surface charge density thereof was measured to be 0.24 $C/m^2$. 10V of voltage was applied to the ITO electrode. Between the electrodes, an electric field of $5\times10^5$ V/m was applied.

Figure 5B:
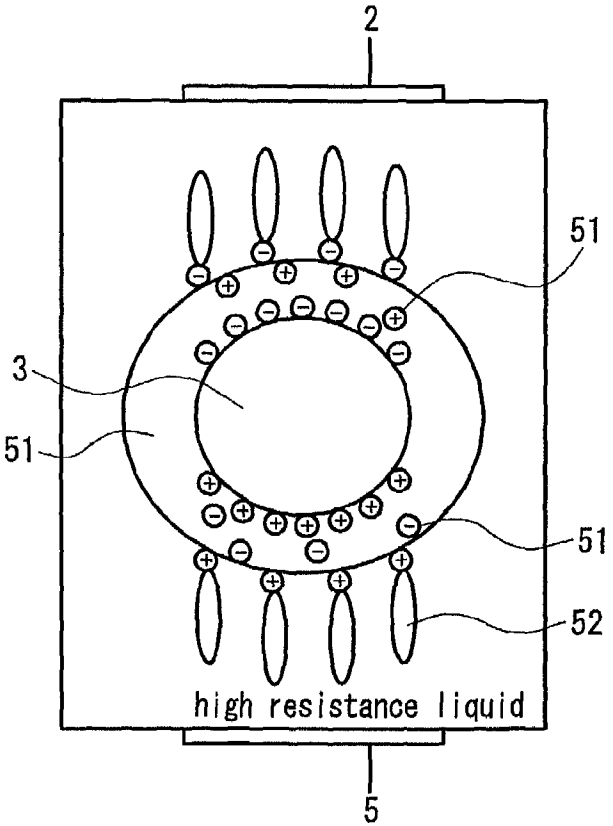
FIG. 5B is a schematic view to illustrate the rotation operation of pixels in a display device according to the first embodiment of the present invention.
Figure 5A:
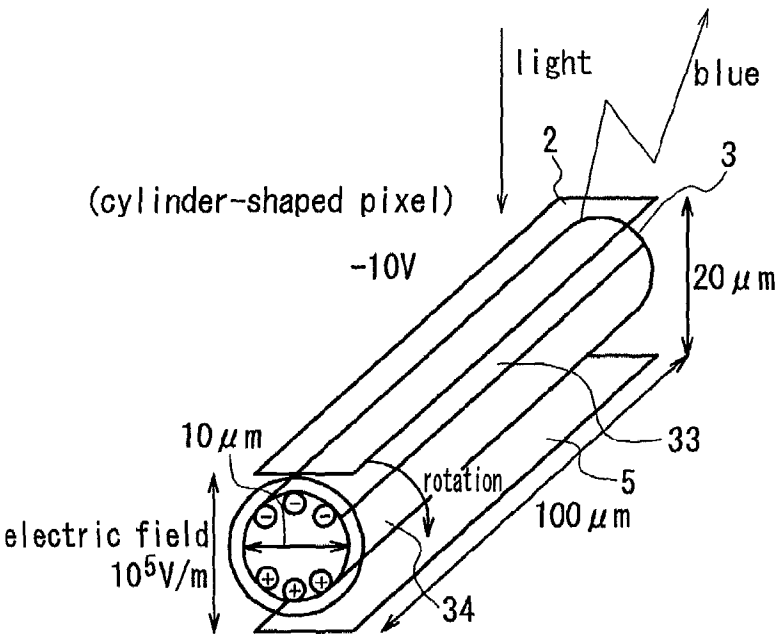
FIG. 5A is a perspective view to illustrate the rotation operation of pixels in a display device according to the first embodiment of the present invention.

FIG. 5B is a schematic view showing a pixel on which adsorbed water 51 and amphoteric surfactant 52 are adsorbed. The pixel was produced by the below-mentioned method. That is, ball-shaped or cylinder-shaped pixels 3 having a diameter of 30 $\mu$m including a cation organic molecular film such as an amino group on one half part of the surface and an anion organic film such as carboxylic acid was exposed to a moisturizing atmosphere for 20 minutes. As a result, the adsorbed water 51 having a thickness of several nm was formed on the surface of the pixels 3.

Next, an amphoteric surfactant 52, for example, a carboxy betaine type lauryldimethyl betaine acetate, a glycine type 2-undecyl-N-carbosymethy-N-hydroxyethyl imidazolinium betaine or alkyl betaine or amidobetaine, or the like is dissolved in an oil-based highly insulating solution such as xylene, toluene, or the like. Then, the pixel 3were dipped in the oil-based liquid.

A mechanism of electrolytic dissociation of a monomolecular film on the surface of the pixel 3 will be explained hereinafter. On the surface of the half part of the pixel 3, a monomolecular film having an amino group on its end group is formed. The thickness of the adsorbed water 51 on the surface of the pixel 3 is about 5 nm and this shows the state in which ten layers of water molecules are attached. When the amphoteric surfactant 52 is attached to the adsorbed water 51, a cation group and an anion group of the surfactant are dissociated by releasing a counter ion 51 into the adsorbed water 51. As result, the ion concentration of the adsorbed water 51 is increased. As the ion concentration is increased, an electrostatic shielding effect occurs, which may lead to easy dissociation of electrolysis of amino group of the monomolecular film on the surface of the pixel 3. Herein, when the thickness of the adsorbed water 51 is beyond the Debye length of the charge potential distribution of the monomolecular film, the degree of electrolytic dissociation of the amino group becomes higher.

The density of the monomolecular film formed on the surface of the pixel is 4 molecules/$nm^2$. On the other hand, since the surfactant that is a charge control agent is larger as compared with the molecules constituting a monomolecule, the attaching density on the surface of the adsorbed water is 0.1 molecules/$nm^2$. Due to the difference in the adhesion density between the monomolecular film and the surfactant, the amount of charges generated on the surface of the pixel can be controlled. In the first embodiment, the amount of charges on the surface of the pixel was measured to be 0.2 $C/m^2$.

FIG. 5B is a schematic view showing a state in which the adsorbed water 51 is formed on the surface of the pixel 3 and the amphoteric surfactant 52 is further adsorbed. However, it is possible to promote the dissociation of the monomolecular film by another method. That is, if a thin film of water that contains 1 mmol/L or less of electrolyte is formed on the surface of the pixel, due to the electrostatic shielding effect of ions generated by the electric dissociation of water, electric dissociation of monomolecular film can be promoted. In order to form a thin film of water, an aqueous solution containing electrolyte is atomized into the particle diameter of 1 $\mu$m or less by ultrasonic wave and a predetermined amount of the atomized particles may be attached to the pixel. By exposing the pixel to the atmosphere of atomized particles for about one minute, several nm-thick thin film of a solution can be formed on the surface of the pixel. Herein, when the thickness of the thin film of the solution is beyond the Debye length of the charge potential distribution of the monomolecular film, larger electric dissociation degree can be obtained.

Figure 6B:
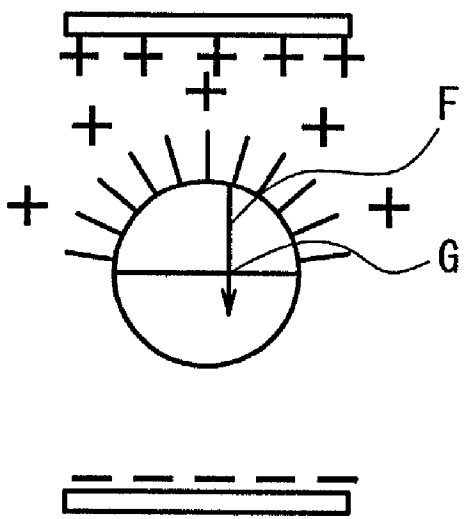
FIGS. 6A to 6B are views to illustrate a rotation operation of a cylinder-shaped pixel in a display device according to the first embodiment of the present invention.
Figure 6A:
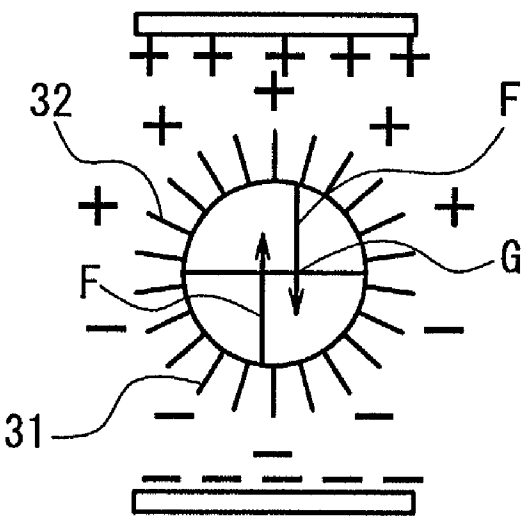

FIG. 6 is a view to illustrate a rotation operation of the cylinder-shaped pixel. In FIG. 6A, due to the charge on the surface of the pixel 3 and the charge on the electrode (herein, an electric field is replaced by an charge), positive charges are repelled with positive charges and negative charges are repelled with negative charges. Thus, repulsive force F is generated and coupling force with respect to the center of gravity G of the pixel is generated. With this coupling force, the cylinder-shaped pixel is rotated and oriented in the opposite direction. When the charges have opposite signs, attraction force occurs and both charges are attracted to each other and the pixel remains at rest. When the sign of the voltage is changed to be opposite, the cylinder-shaped pixel is rotated further in accordance with the change. The rotation rate of the cylinder-shaped pixel was measured to be about 1 msec.

FIG. 6B shows a case where charges are present in the half part of the surface of the pixel and no charges are present in another half part of the surface of the pixel. As in FIG. 6A, positive charges are repelled with positive and repulsive force F is generated on the surface of the ball-shaped pixel. If there is unbalanced distribution of charges, even if the amount is small, not only the repulsive force F generating translational motion but also torque with respect to the center of gravity G are present. With this torque, the cylinder-shaped pixel is rotated and oriented in the opposite direction. When the charges are present on the half surface, the rotation response speed of the cylinder-shaped pixel was measured to be about 5 msec.

Second Embodiment

The structure and operation of a display device using cylinder-shaped pixels according to the second embodiment of the present invention will be explained with reference to a schematic view shown in FIG. 1. The structure according to a second embodiment includes a pair of transparent substrates 1 made of glass, etc. facing each other in proximity; a pair of transparent electrodes 2 disposed on the facing surfaces of the transparent substrates 1; and cylinder-shaped pixels 3 disposed between the transparent electrodes 2.

Then, a half part 6 of the cylinder-shaped pixels made of glass, etc. are colored in blue. The blue coloring is carried out by vapor deposition of potassium silicate glass containing a cobalt ion to a thickness of 1 $\mu$m on the surface of the cylinder-shaped glass and firing thereof. In the second embodiment, a monomolecular film of 10-carboxydecyl trichlorosilane having a carboxyl group (—COOH) on the surface thereof was formed as a monomolecular film having negative charges on the half part colored in blue. The surface charge density of a monomolecular film having a dissociated carboxyl group was measured to be 0.2 $C/m^2$.

For another half part, a material is obtained by working opal glass containing a foreign particulate substance having a different refractive index in glass into a cylinder shape 3. A monomolecular film capable of carrying positive charges, a monomolecular film made of 3-aminopropyltrimethoxysilane having an amino group —$NH_2$ in the second embodiment, is formed. The surface charge density of a monomolecular film having an ionized amino group was measured to be 0.24 $C/m^2$.

Next, electrodes were formed of a material such as ITO. Then, an insulating layer was formed on the electrodes, and the surface thereof was polished so as to secure the surface smoothness. To the electrodes, an electric field of $5\times10^5$ V/m is applied. When the space between the electrodes is 20 $\mu$m, the voltage is 10 V When the sign of the voltage is changed, in accordance with the change, the sign on the cylinder surface is changed, thus to change attractive force or repulsive force of the organic molecular film. Accordingly, torque was applied to the organic molecular film in the direction of the tangent to the rotation direction, thus rotating the cylinder-shaped pixel. The response speed of the cylinder was measured to be about 2 msec.

The structure of the display device according to the second embodiment is as shown in FIG. 2. Three primary colors of red: R, green: G and blue: B of the cylinder-shaped pixels are arranged as one group in rows and column in a matrix shape. The state of the pixels is selected based on the ON/OFF information of each pixel in accordance with the upper transparent electrode in a row and the bottom transparent electrode in a column. In each pixel, in accordance with the voltage given to a portion between the electrodes, a surface having each coloring agent of RGB or a surface having a white coloring agent appears with respect to the incident direction of light.

Then, by sequentially switching the electrodes in a row, an image is written with respect to the entire screen. When each pixel is stopped after the rotation, each pixel does not move unless force, which is relatively different from that of the cell, is applied to the pixel itself from the outside. Therefore, the memory effect is exhibited and the rotation position can be stored even after the power source is turned off.

Third Embodiment

Hereinafter, the third embodiment will be explained with reference to drawings. An example of the pixel structure used for the third embodiment is shown in FIG. 1. The display device according to the third embodiment includes a pair of transparent substrates 1 made of glass etc. facing each other in proximity; a pair of transparent electrodes disposed on the facing surfaces; and ball-shaped or cylinder-shaped pixels 3 disposed between the transparent electrodes.

Then, a half part of the ball-shaped or cylinder-shaped pixels is colored; a monomolecular film having charges is formed on the colored half part; and a monomolecular film having opposite charges is formed on another half part. The ball-shaped or cylinder-shaped pixels are dipped in a solvent.

When the transparent substrates, the transparent electrodes formed on the facing surfaces, and the liquid filled between the transparent electrode and the ball-shaped or cylinder-shaped pixels, which are disposed in a path where light enters, passes through and is reflected, have different refractive indexes from each other, reflection loss occurs due to the difference of refractive indexes in each interface. The reflection loss causes the double image due to the reflection at the interface, which may lead to the deterioration in contrast or image. Therefore, it is preferable that the difference in the refractive indexes between the transparent substrate and the liquid is as small as possible. The difference in the refractive indexes is preferably 0.1 or less, and more preferably 0.03 or less.

In order to make the reflection loss to be zero, the following two conditions are required to be satisfied: (1) the intensity of the reflected light from the external surface of the transparent electrode thin film is equal to the intensity of the reflected light from the internal surface of the transparent electrode thin film; and (2) the intensity of both reflected light from the external surface and the internal surface are offset by each other by interference.

Furthermore, in order to satisfy the condition (2), the difference between the two reflective light paths, that is, the thickness of the transparent electrode, has to be an odd multiple of one-half the light wavelength.

Table 1 shows the liquid and the transparent members and the refractive indexes thereof.

TABLE 1

| material for transparent member | refractive index | liquid material | refractive index |
|---|---|---|---|
| phenylene oxide resin | 1.27 | hexane | 1.327 |
| | | water | 1.333 |
| | | perfluorotoluene | 1.368 |
| | | methyl ethyl ketone | 1.379 |
| | | diethylcarbonate | 1.384 |
| vinyl butyral | 1.47–1.49 | chloroform | 1.446 |
| methyl methacrylate | 1.48–1.50 | 6-chlorohexanol | 1.456 |
| | | xylene | 1.495 |
| optical glass | 1.45–1.75 | toluene | 1.496 |
| acrylic resin | 1.50–1.575 | 2-phenoxypropionyl chloride | 1.513 |
| vinyl chloride resin | 1.52–1.55 | | |
| epoxy resin | 1.55–1.61 | | |
| polycarbonate | 1.586 | | |
| polystyrene | 1.59 | | |
| vinylidene chloride | 1.6–1.63 | phenoxystyrene | 1.602 |
| polyalylate | 1.6–1.7 | α-bromonaphthalene | 1.66 |
| magnesium oxide | 1.737 | diiodo-methane | 1.737 |
| α-alumina | 1.76 | | |

When the refractive index of the liquid is "na", the refractive index of the transparent electrode is "nf", and the refractive index of the substrate is 5 ng, the reflectance R at the interface can be expressed by the following equation (Formula 1) by Fresnel's formula:

Reflectance on interface of liquid/transparent electrode $$Raf=(nf-na)^2/(nf+na)^2$$

Reflectance on interface of transparent electrode/substrate $$Rfg=(ng-nf)^2/(ng+nf)^2 \quad \text{(Formula 1)}$$

When the refractive index of liquid is equal to the refractive index of the substrate as shown in Table 1, that is, when "na=ng" is satisfied, the reflectance on the interface between liquid and transparent electrode is equal to the reflectance on the interface between the transparent electrode and the substrate as shown in Formula 2, and thus the condition (1) is satisfied.

$$Raf=Rfg \quad \text{(Formula 2)}$$

From Table 1, when the transparent substrate is phenylene oxide resin and the liquid is hexane, water, perfluorotoluene, methyl ethyl ketone, or diethylcarbonate, the difference in the refractive index therebetween is 0.1 or less, and the condition (1) is satisfied. Furthermore, when the transparent substrate is vinyl butyral, methyl methacrylate or optical glass, and the liquid is chloroform, 6-chlorohexanol, xylene or toluene, the difference in the refractive index therebetween is 0.1 or less, and the condition (1) is satisfied. Furthermore, when the transparent substrate is vinyl chloride resin, acrylic resin, epoxy resin, polycarbonate or polystyrene, and the liquid is 2-phenoxypropionyl chloride, or phenoxystyrene, the difference in the refractive index therebetween is 0.1 or less, and the condition (1) is satisfied. Furthermore, when the transparent substrate is vinylidene chloride, polyalylate, magnesium oxide, or α-alumina, and the liquid is phenoxystyrene, α-bromonaphthalene, or diiodo-methane, the difference in the refractive index therebetween is 0.1 or less, and the condition (1) is satisfied.

Furthermore, when the thickness of the transparent electrode is an odd multiple of one-half the light wavelength, the condition (2) also is satisfied and there is little loss of light passing through the both interfaces.

The liquid is insulating liquid and is obtained by mixing water, surfactant or water +surfactant at the ratio of 1 weight % or less. Water or surfactant is adsorbed to the surface of the monomolecular film, inhibiting the length of the diffusion (Debye length) of the charge on the surface of the monomolecular film depending upon the size of the molecule, structure or the nature of the polar group. The Debye length was 50 nm.

Fourth Embodiment

Figures 7A, 7B, 7C, 7D:
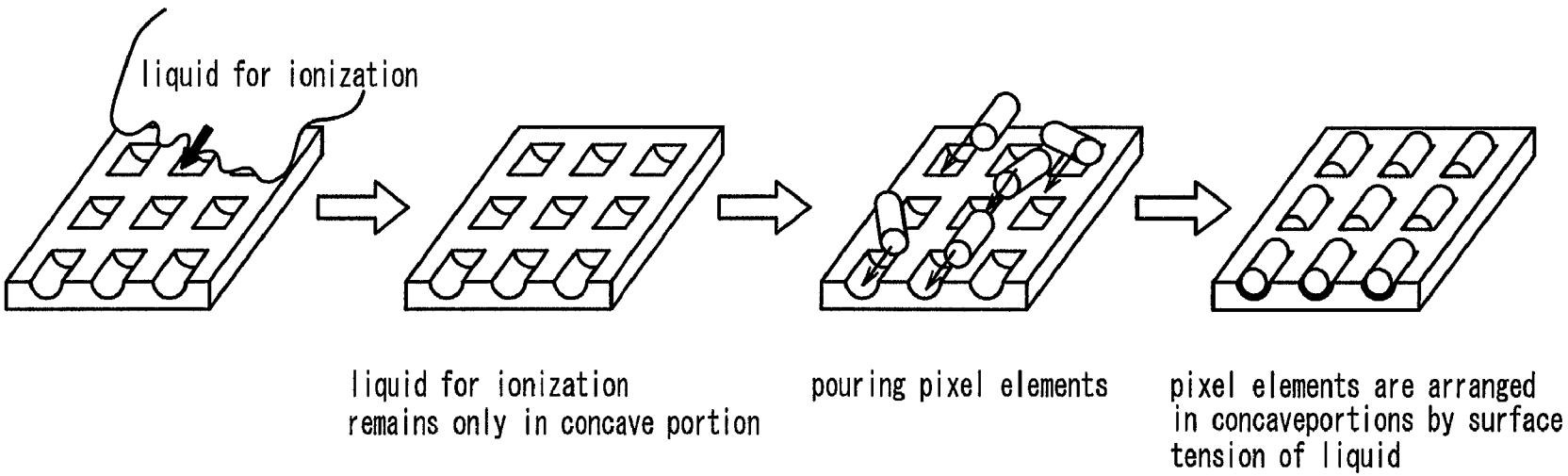
FIGS. 7A to 7D are views showing steps for arranging pixel elements in a display device according to a fourth embodiment of the present invention.
Figure 8A:
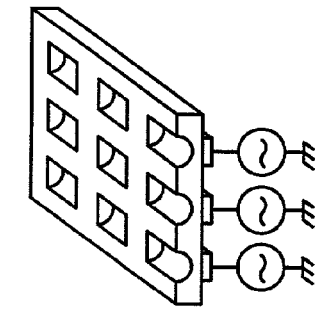
FIGS. 8A to 8E are views to illustrate steps of a method for arranging pixels in a display device according to a fifth embodiment of the present invention.
Figure 8B:
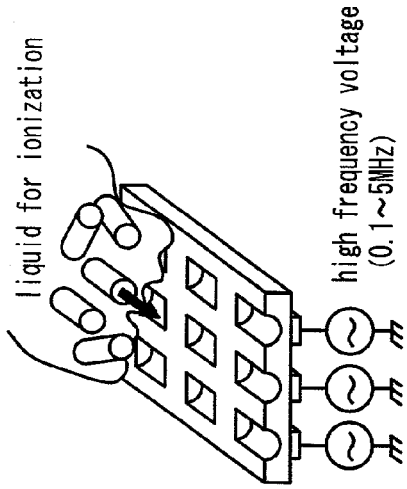
Figure 8C:
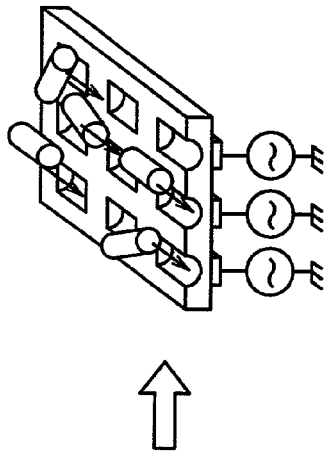
Figure 8D:
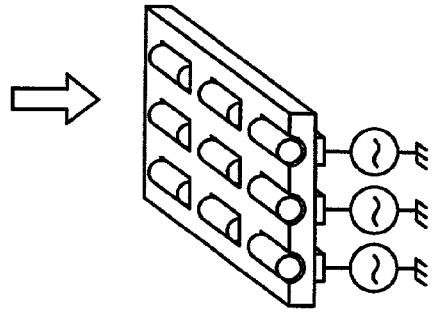
Figure 8E:
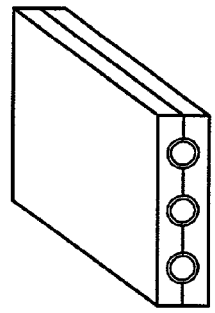

FIG. 7 shows a method for manufacturing a display device as to the method for arranging the pixels using water-repellent films according to the fourth embodiment of the present invention. As shown in FIG. 7A, first, a pattern in which holes 110 μm×12 μm in size and 11 μm in depth are arranged in rows and columns at intervals of 2 μm was formed on the surface of glass substrate 50 mm×50 mm in size and 0.2 mm in thickness. The pattern formation was carried out by a general photolithography.

After a negative type resist was applied onto a glass substrate, by the use of a photo mask, exposure, development and post bake were carried out to form a resist pattern in which the hole portions having a size of 110 μm×12 μm are arranged in rows and columns at intervals of 2 μm. Thereafter, the glass substrate was provided with holes having a depth of 5 μm by etching. Moreover, the etching was carried out by the use of a 80° C. or more of solution of sodium hydroxide or an aqueous solution of hydrofluoric acid. Thereafter, the resist film was peeled off.

Next, as shown in FIG. 7B, chromium was evaporated onto the glass substrate to the thickness of 100 nm. Then, resist solution was coated on the entire surface of the substrate by the use of spray apparatus. The spray device used herein is an air spray device produced by Nordson KK. The use of this spray device makes it possible to apply resist solution to the inside of the hole of the glass.

Next, the substrate was subjected to the pre-baking, exposure and development by the use of a predetermined photo mask so as to remove resist from the portion other than holes. Thereafter, the substrate was subjected to post baking, the substrate was dipped in an etching solution for chromium, for example, a mixture of sodium hydroxide and sodium dichromate, a mixture of ferric chloride and concentrated hydrochloric acid, hydrochloric acid, or the like so as to remove chromium from the portion other than holes. Furthermore, the resist was peeled off and removed. As a result, chromium remains only in the holes and in the other place, glass substrate surface was exposed.

Next, in a low humidity atmosphere, this glass substrate was dipped in a hexadecane solution in which 1 vol % of octadecyltrichlorosilane ($CH_3(CH_2)_{15}SiCl_3$) are dissolved for 30 minutes. Thereafter, the substrate was taken out from the solution and immediately washed with a chloroform solution. As a result, a monomolecular film of octadecyltrichlorosilane was formed on the exposed form of the glass. This film provides the substrate with the water-repellent property. Furthermore, the substrate was dipped in the etchant for chromium again to remove chromium. Since this monomolecular film was resistant with respect to the etching solution of chromium, chromium remained without being removed. As a result, it is possible to obtain a glass substrate in which a glass surface was exposed on the hole portions and the glass substrate coated with the monomolecular film of octadecyltrichlorosilane on the portions other than the hole portions.

As shown in FIG. 7C, a solution in which cylinder-shaped pixels having a diameter of 10 $\mu$m and the length of 100 $\mu$m are dissolved was poured from one side to another of the glass substrate. As a result, the cylinder-shaped pixel elements are disposed in the concave portions on the substrate attracted by the surface tension as shown in FIG. 7D.

In the fourth embodiment, as the film providing the pixels with the water-repellent property, octadecyltrichlorosilane was used. This can provide the substrate with a high water-repellent property. Furthermore, the monomolecular film is not necessarily limited to this and any of $CH_3(CH_2)_n SiCl_3$ (n=0–20) may be used. Furthermore, in a case where the organic solvent having the surface tension that is lower than that of water is used, a monomolecular film having a fluoroalkyl chain, for example, $CF_3(CF_2)_n(CH_2)_2SiCl_3$ (n=0–8), can be used.

Fifth Embodiment

FIG. 8 shows a method for arranging pixels using an electric field. As shown in FIG. 8A, electrodes are formed on an insulating substrate and 0.1 to 5 MHz of alternating electric field is applied between electrodes on the substrate when liquid for ionization and pixel elements flows (FIG. 8B). Between the electrodes, about 10 V of alternating voltage was applied. If an alternating electric field is applied to the insulating material, the insulating material on the surface of the electrode has charges by the difference of the mobility between the hole and electron. First, alternating voltage is applied in the equal ratio of plus and minus. However, with the passage of time, negative charges are accumulated and so the voltage of the electrode gradually changes to the direction of minus, and a self-bias voltage excluding the voltage corresponding to the back-flow of electrons is applied to the electrode. Due to the organic molecular film having charges and the self-bias voltage, an electric field is applied between the organic molecular film having charges and the electrode, generating the repulsive force or attractive force between the charges of the organic molecular film attached to the surface of the pixel and the electric field (FIG. 8C). Then, the pixels in the vicinity of the electrode are attracted to the inside of the grooves by the induction interaction and are arranged therein (FIG. 8D). Finally, an upper substrate is adhered to the substrate while positioning, hermetically sealing in a sheet form (FIG. 8E).

In the case where the medium is a conductive material, an insulating film is formed on the surface of the organic molecular film and the electrode so that the entire medium is apparently insulating, thus forming a structure in which an electric field can be applied.

Sixth Embodiment

Figures 9A, 9B, 9C, 9D, 9E, 9F, 9G, 9H:
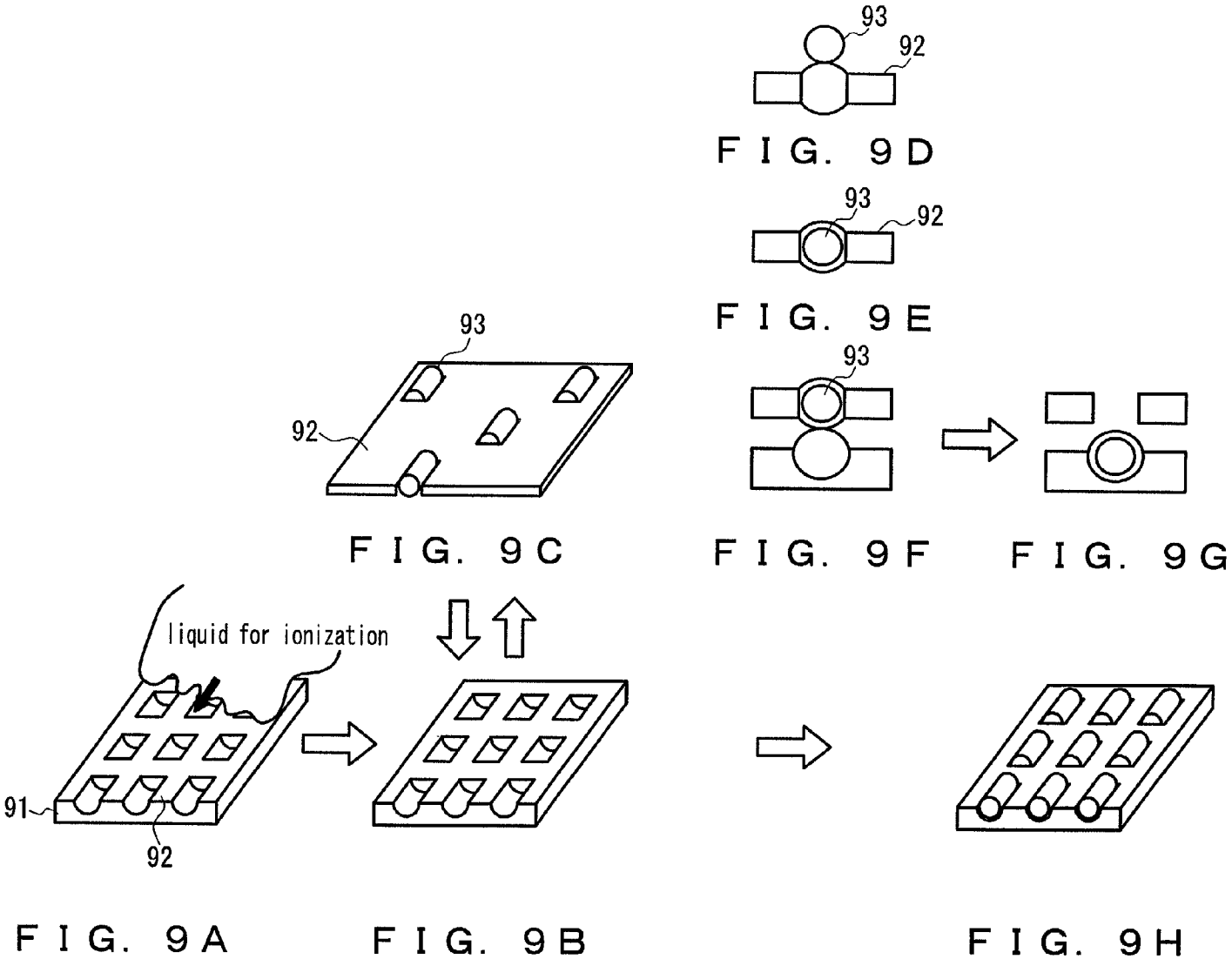
FIGS. 9A to 9H are views to illustrate a method for arranging three-color pixels according to a sixth embodiment of the present invention.

FIG. 9 shows one method for manufacturing the display device relating to a method for three-color pixels using the water-repellent property according to the sixth embodiment of the present invention. As shown in FIG. 9A, first, a pattern in which holes 110 $\mu$m×12 gm in size and 11 $\mu$m in depth are arranged at intervals of 2 $\mu$m was formed on the surface of the glass substrate 91, 50 mm×50 mm in size and 0.2 mm in thickness. Similar to the case of using one color, the pattern formation was carried out by a general photolithography.

Namely, a resist pattern 110 $\mu$m×12 $\mu$m in size having hole portions arranged at intervals of 2 $\mu$m in rows and columns was formed with a negative type resist. Thereafter, the glass was provided with holes having a depth of 5 $\mu$m by etching. The resist film was peeled off and then an organic molecular film 92 of octadecyltrichlorosilane was formed on the glass-exposing surface on the glass substrate by using chromium as a mask. This organic film 92 provides the glass substrate 91 with a water-repellent property. Furthermore, the glass substrate 91 was dipped in the etchant of chromium so as to remove chromium. Since the organic molecular film was resistant with respect to the etchant for chromium, it remained without being removed. As a result, as shown in FIG. 9B, it was possible to obtain a glass substrate in which the glass surface was exposed on the hole portions and the glass substrate coated with the organic molecular film 92 of octadecyltrichlorosilane on the portions other than the hole portions.

On the other hand, a mask for arranging cylinder-shaped pixels 93 having a diameter of 10 $\mu$m and a length of 100 $\mu$m in colors of RGB as one group as shown in FIG. 7C is prepared as shown in FIG. 9C. For the material for the mask, glass and stainless steel are selected. The case using the stainless steel mask is explained herein, however, the same is true in the case of a glass or other materials. The 100 $\mu$m-thick stainless steel mask has grooves in a part of the pixel arrangement corresponding to, for example, red (R). Similar to the glass substrate 91, all except for the concave portion containing the pixel element 93 is covered with a water-repellent organic molecular film 92. The wall surface of the concave portion is set to be a hydrophilic stainless steel surface.

An aqueous solution is allowed to flow from one side to another on the stainless steel mask. As shown in FIG. 9D, liquid remains in the groove. By causing the pixel element 93 to flow on the stainless steel, the cylinder-shaped pixels are brought into contact with the liquid for ionization and are taken into the liquid.

As a result, the cylinder-shaped pixel elements are disposed in the grooves of the stainless steel mask, as shown in FIG. 9E. When this stainless mask is brought near to the glass substrate 91 in which liquid for ionization remains, the liquid on the stainless mask and the liquid on the glass substrate 91 are fused as shown in FIG. 9F.

Then, from one side of the stainless steel mask, the liquid in the groove of the stainless mask is evaporated by the use of dried air or heat ray. Thus, as shown in FIG. 9G, the pixel element 93 is contained in the concave portion of the glass substrate 91. By repeating this process of arranging R pixels with respect to green pixels (G) and blue pixels (B), the green pixels (G) and blue pixels (B) are arranged. Thus, as shown in FIG. 9H, after three processes, the pixels 93 of RGB are arranged in the concave portions of the glass substrate 91.

In the process of fusing the liquid on the mask and the liquid in the groove, pixels may be contained in the concave portion of the substrate by fusing the liquid in the groove of the mask by the dried air from one side of the mask. By repeating the processes corresponding to each color of the pixel of RGB, pixels of each color are arranged.

Furthermore, in the process of fusing the liquid on the mask and the liquid in the groove, a mask having convex portions corresponding to the concave portions for containing pixels from one side of the mask may be used. Thereby, if the liquid in the grooves is fused into the concave portions of the glass substrate so that the pixels are contained in the concave portions of glass substrate, the pixels can be arranged.

In the sixth embodiment, the case where the mask is made of stainless steel was explained, however, the mask may be silicon, silicon nitride or glass. With such materials, the same configuration and same manufacturing method can be carried out. Furthermore, in the sixth embodiment, the liquid was an aqueous solution and the film was water-repellent film. If the liquid is oil, an oil repellent monomolecular film preferably is used.

Figure 10:
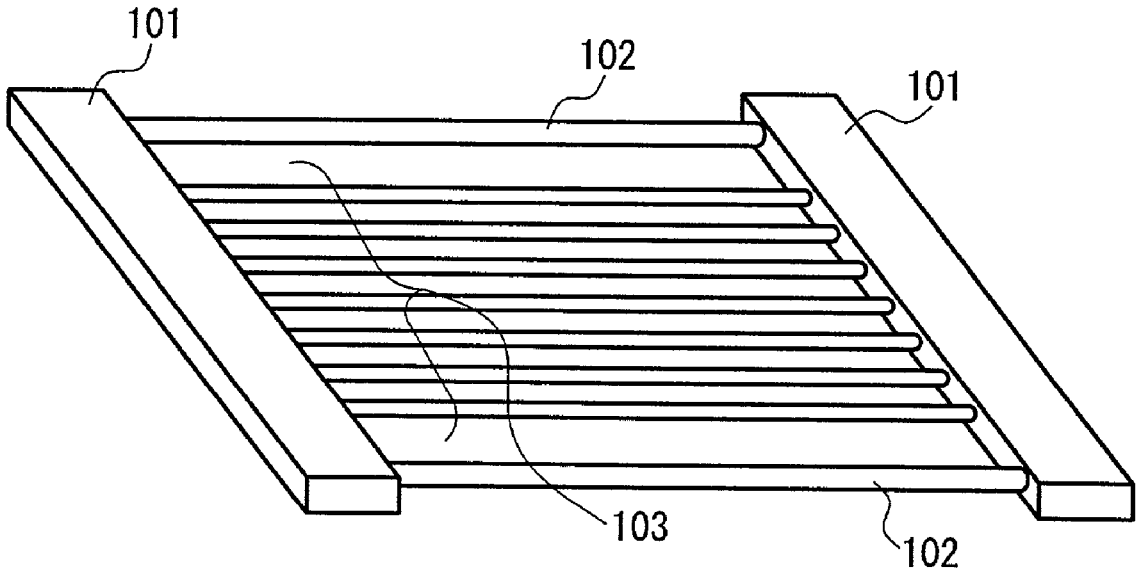
FIG. 10 is a perspective view showing a jig used for a method for arranging three-color pixels according to the sixth embodiment of the present invention.

Furthermore, the following method can be applied. By using a jig as shown in FIG. 10, plastic optical fiber 103 having a diameter of 10 $\mu$m and the length of 200 mm were fixed at intervals of 5 $\mu$m. The jig includes a fixing portion 101 for fixing fiber at equal intervals and a spacer 102 for keeping the fixing portions at constant intervals.

One part of the fiber was colored and provided with charge by the organic molecular film by the same method mentioned above. However, the coating of pigments to the fiber after the resist was coated was carried out as follows.

Namely, the pigment was applied to a half part of the fiber by a vapor evaporation method, and then another half part of the fiber was directed to the direction of the evaporation source and the vapor deposition method was carried out again. As a result, it was possible to apply the pigments to the entire surface of the fiber.

Figure 11C:
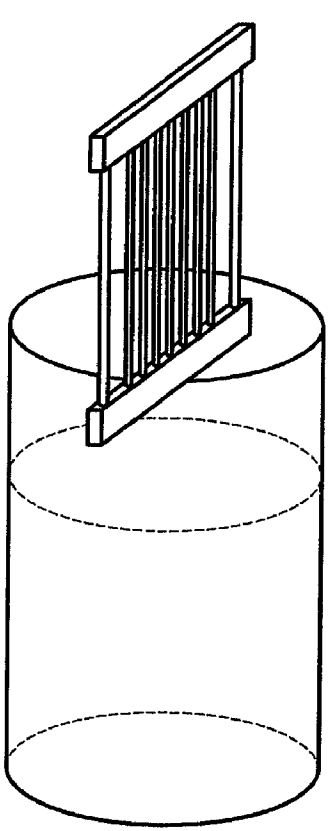
FIGS. 11A to 11C are views to illustrate steps of a method for arranging the three-color pixels according to the sixth embodiment of the present invention.
Figure 11B:
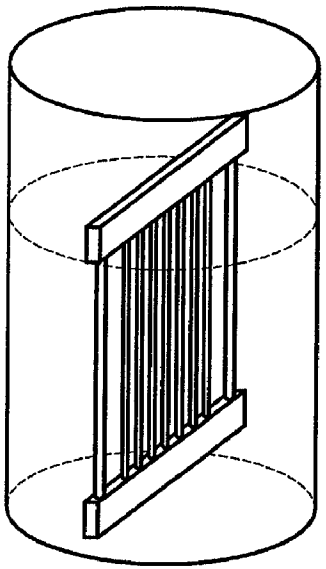
Figure 11A:
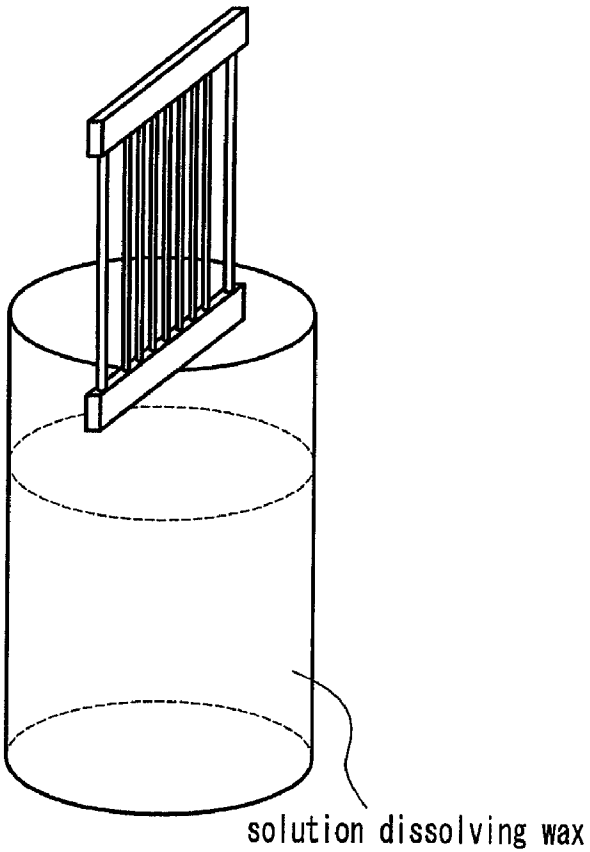

Next, FIG. 11 shows a method for providing wax functioning as a sacrificial film on the fiber. First, as shown in FIG. 11A, the jig is dipped so that the surface of an acetone solution containing 0.3 wt. % wax was perpendicular to the longitudinal direction of the fiber. Thereafter, as shown in FIG. 11B, the jig was dipped in the solution for 30 seconds and then the jig was taken out from the solution as shown in FIG. 11C and naturally dried. As a result, on the surface of the fiber, about 1 $\mu$m-thick wax thin film was formed.

Figure 12C:
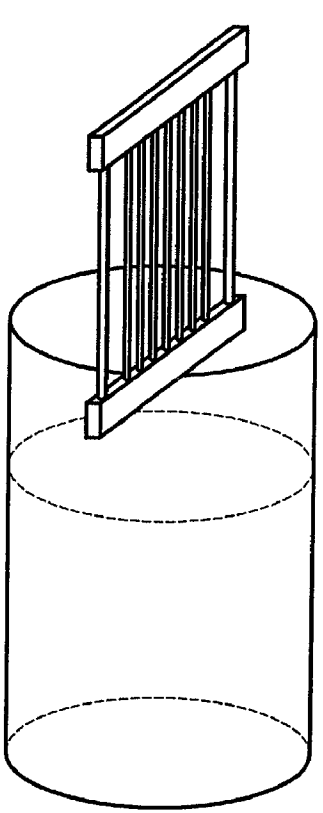
FIGS. 12A to 12C are views to illustrate a method for arranging the three-color pixels according to the sixth embodiment of the present invention.
Figure 12B:
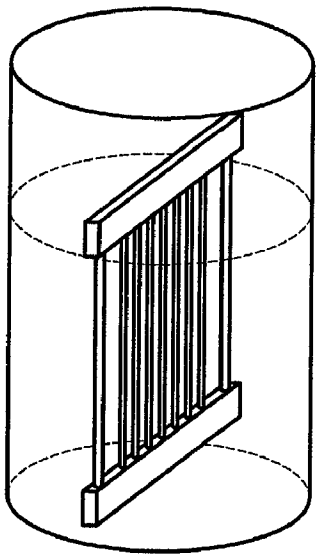
Figure 12A:
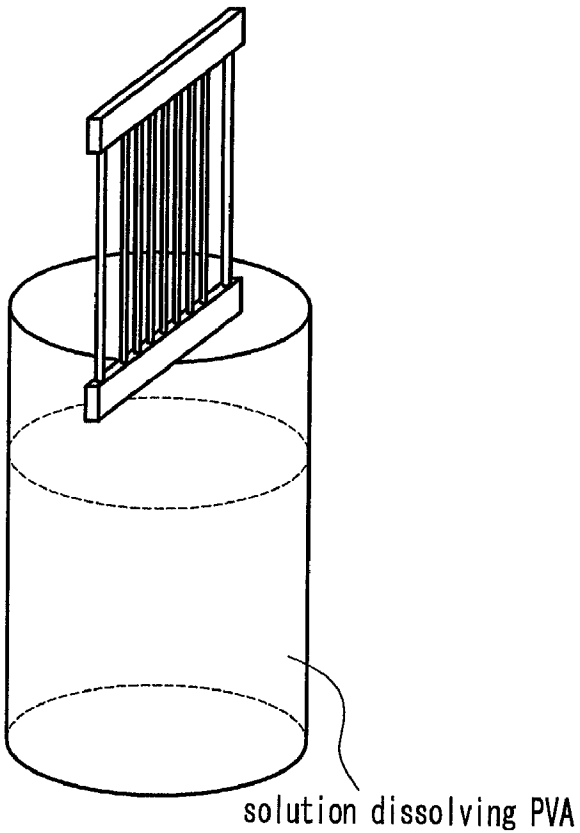
Figure 13:
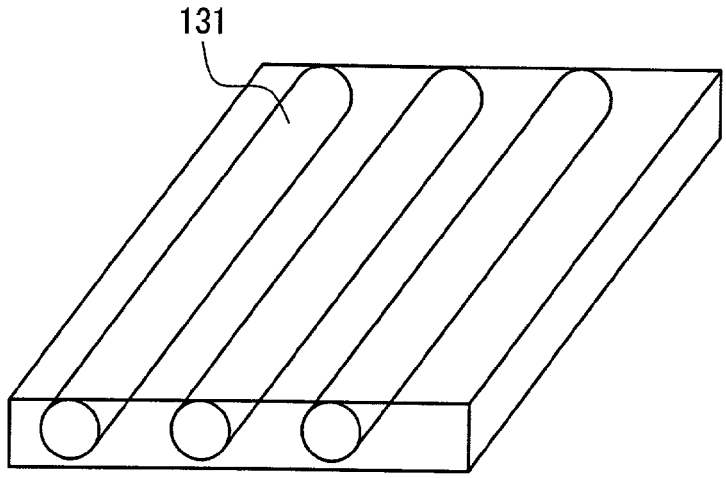
FIG. 13 is a view showing a fiber sheet as a final product in a method for arranging three-color pixels according to the sixth embodiment of the present invention.

FIG. 12 shows a method for inserting fiber into a polyvinyl alcohol (PVA) sheet. First, as shown in FIG. 12A, the jig was dipped so that the surface of an ethanol solution containing 70 wt. % of PVA was perpendicular to the longitudinal direction of the fiber. Thereafter, as shown in FIG. 12B, the jig was dipped in the solution for 30 seconds and then the jig was taken out from the solution as shown in FIG. 12C and naturally dried. Since this solution had high viscosity, PVA also was formed between fibers. As a result, a sheet in which fibers 131 were inserted at constant intervals was formed (FIG. 13).

Figure 14:
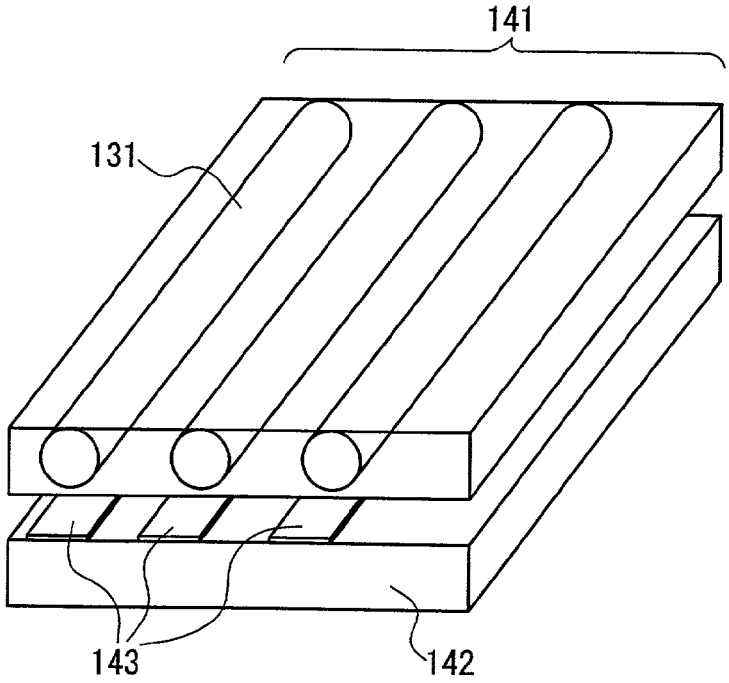
FIG. 14 is a view showing one step in a method for manufacturing a display device using a method for arranging three-color pixels according to the sixth embodiment of the present invention.

Next, as shown in FIG. 14, the sheet 141 was taken out from the jig and attached to the glass base material 142. On the surface of the glass base material 142 attached to the sheet 141, linear electrodes 143 having a width of 10 $\mu$m are formed at intervals of 5 $\mu$m. The fiber 131 in the sheet 141 is parallel to the electrode 143, and the sheet 141 was attached onto the electrode 143 so that the fiber 131 was positioned onto the electrode 143.

Figure 15A:
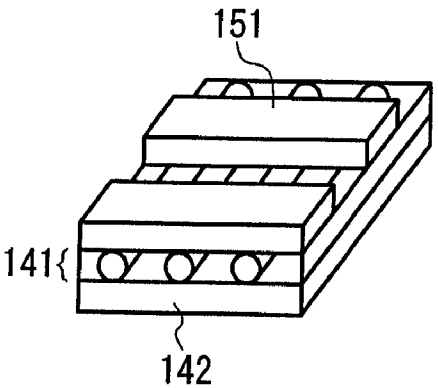
FIGS. 15A to 15C are views to illustrate a method for arranging the three-color pixels according to the sixth embodiment of the present invention.
Figure 15B:
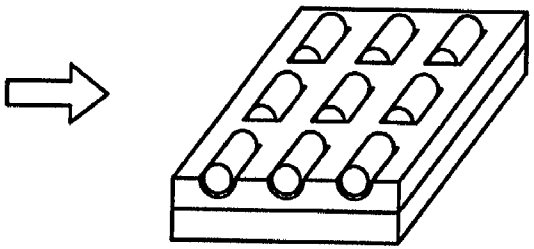

Next, as shown in FIG. 15A, resist patterns 151 were formed on this sheet 141, and the portion of the sheet 141 other than the portion with resist patterns and the fiber 131 were removed by plasma etching, and then the resist pattern 151 was peeled off. Next, as shown in FIG. 15B, PVA was coated on the sheet by spin coating and filled the concave portion formed by plasma etching. As a result, a sheet in which cylinder-shaped fibers having a diameter of 10 $\mu$m and the length of 100 $\mu$m were inserted into the PVA sheet was formed.

Figure 15C:
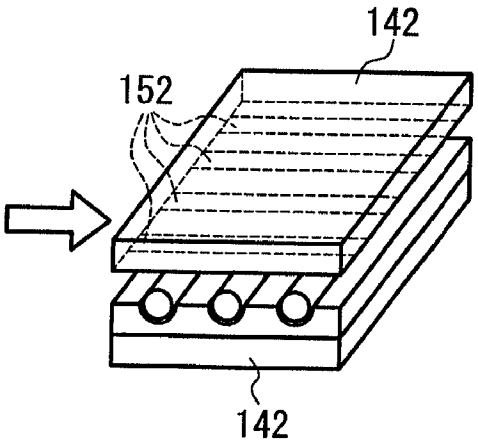

Next, as shown in FIG. 15C, a glass substrate 142 was attached to the upper surface of the sheet. On the attached surface of the upper glass substrate 142, the upper electrodes 152 having a width of 100 $\mu$m and perpendicular to the fiber 131 are formed at constant intervals of 5 $\mu$m. This electrode 152 is disposed so as to be positioned on the upper surface of the cylinder-shaped fibers.

Next, a sheet sandwiched by two glass plates was dipped in an acetone solution for 30 minutes. As a result, acetone filled in the sheet so as to dissolve the wax formed on the surface of the fibers. As a result, the cylinder in the sheet was contained in the cylinder-shaped holes and a predetermined gap was generated between the cylinder and the hole, and thus the cylinder was able to be rotated in the holes.

Furthermore, this sheet was dipped in a toluene solution for 30 minutes. As a result, the toluene solution was filled in the holes. Through the series of processes, the display main body was formed.

Furthermore, the below mentioned method also is possible. That is, by the same method as mentioned above, a sacrificial film was formed on the cylinder-shaped plastic surface. Then, the fibers were cut into a length of 100 $\mu$m.

Figure 16:
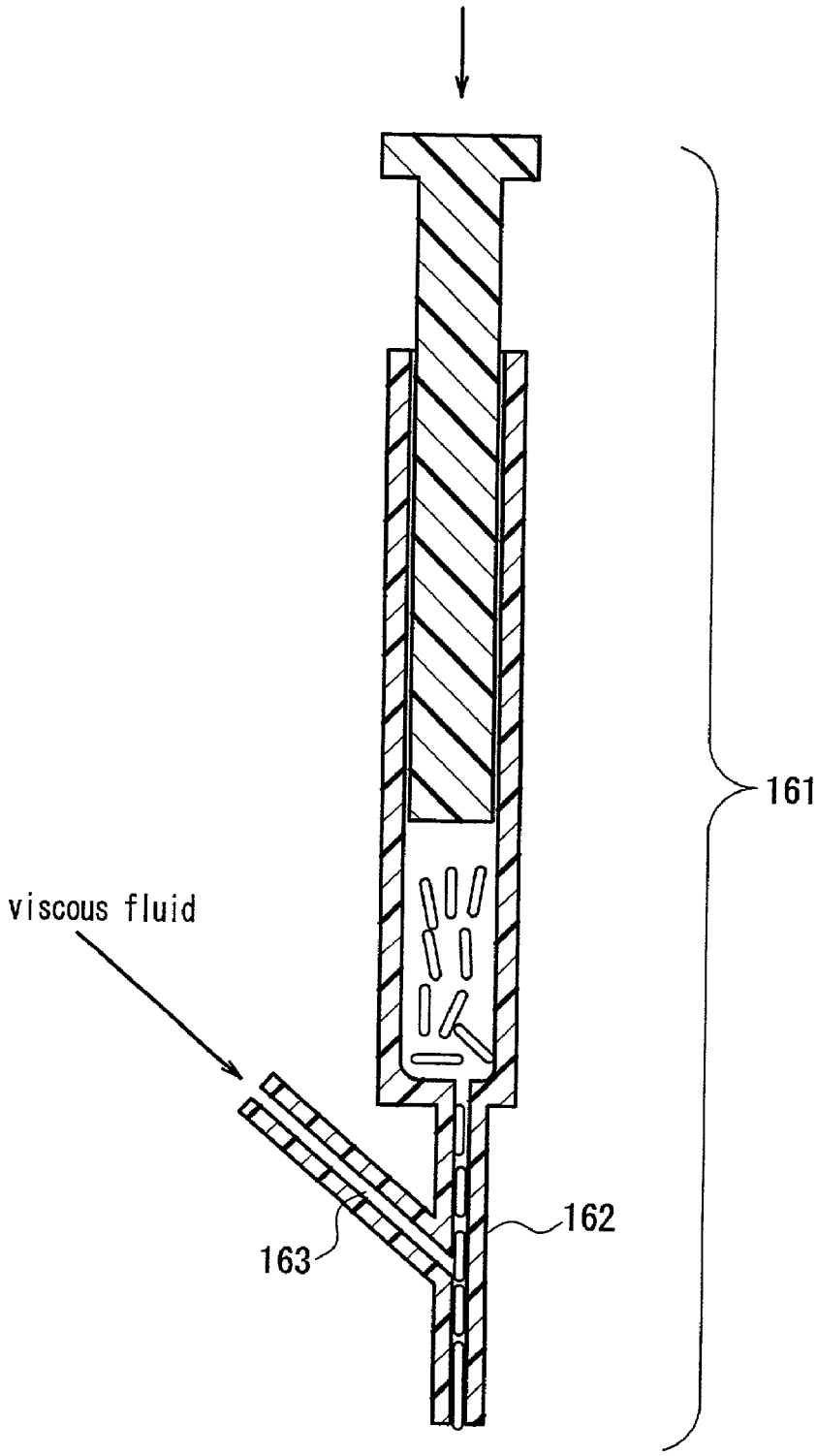
FIG. 16 is a sectional view showing a configuration of dispenser used for a method for manufacturing a three-color pixels according to the sixth embodiment of the present invention.

Next, the fibers were disposed in a dispenser having a shape shown in FIG. 16. A needle point 162 of the dispenser 161 has an inner diameter of 150 $\mu$m and a length of 10 mm. Furthermore, the needle point has a forked shape and viscous fluid can be inserted from one flowing passage 163.

Figure 17:
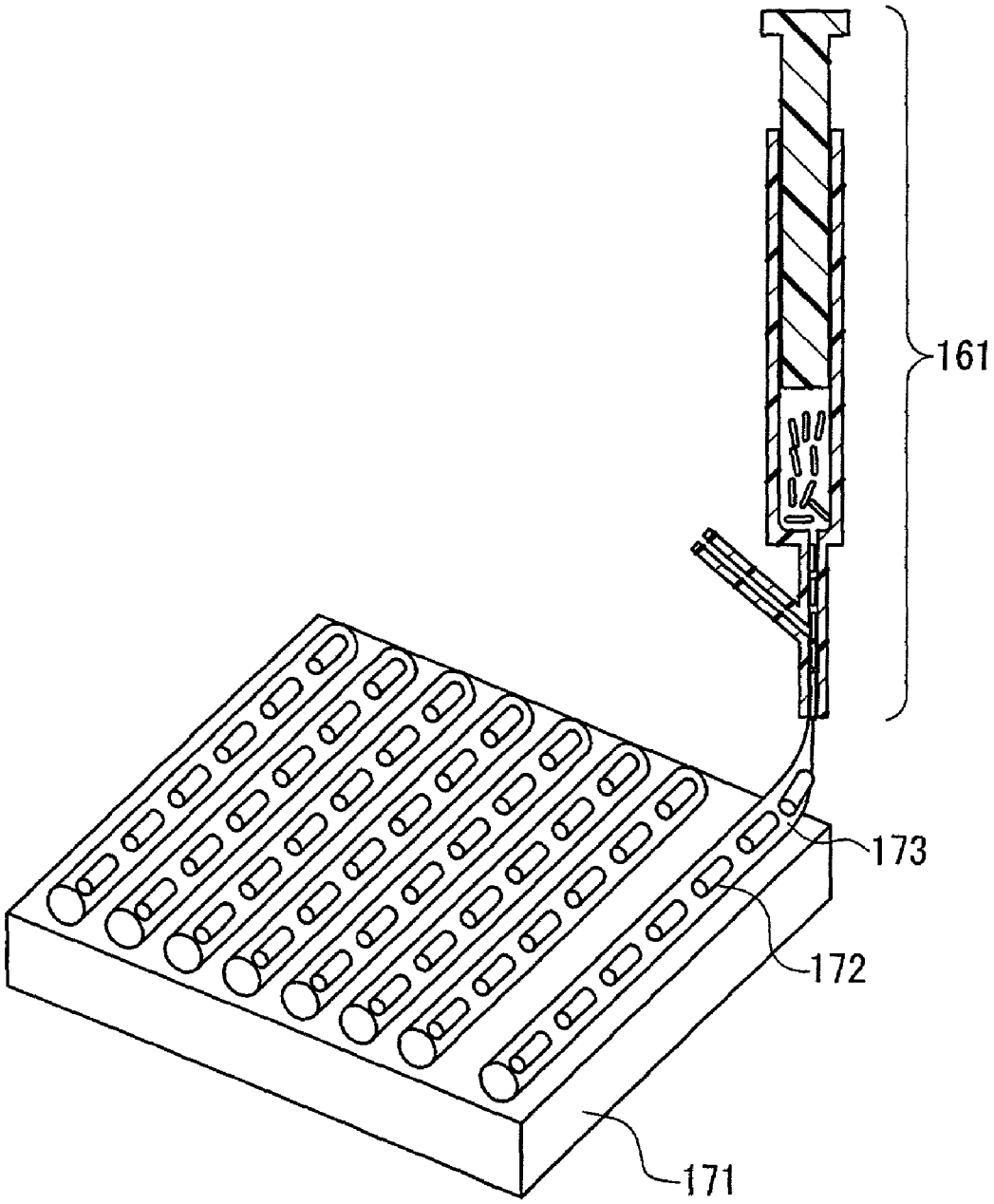
FIG. 17 is a view to explain a method for manufacturing three-color pixels according to the sixth embodiment of the present invention.

In the embodiment of the present invention, an ethanol solution containing 70 wt. % of PVA was allowed to flow from the flow passage 163. Then, by using this dispenser 161, on the glass base material 171 on which a linear electrode was formed, cylinder-shaped fiber 172 and PVA mixing solution 173 were arranged at predetermined intervals (FIG. 17). The flow rate of PVA extruded from the flow passage 163 and the flow rate of extruding the cylinder-shaped pixel was set to be an optimum value, and thus a line of PVA aligned at predetermined intervals was obtained. Furthermore, a line of PVA was disposed on the linear electrode. Thereafter, further PVA was applied and a sheet of PVA was formed on the line. Then, the same process was carried out, and thus a display main body was produced.

Furthermore, instead of a glass substrate used in the sixth embodiment, a thin-film transistor (TFT) and accumulation capacitance are formed in each pixel, and then the TFT substrates in which pixels are connected by aluminum wiring are used as one substrate so as to form a panel.

The panel having such a configuration was driven by DC5V drive and the operation was tested. It was confirmed that the rotation speed was about 13 msec. Furthermore, the contrast was 1.05 by luminous intensity ratio. Furthermore, when contrast was compared before and after the driving was carried out at the DC voltage of 5V and at room temperature for 500 hours, no change in contrast was found and no ghosting was observed.

Figure 20A:
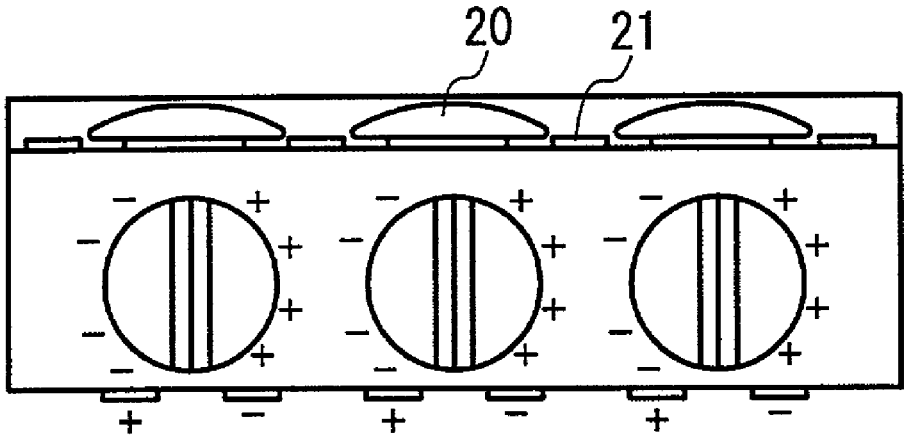
FIGS. 20A to 20B are views showing a method for arranging lens in the display device according to the present invention.
Figure 20B:
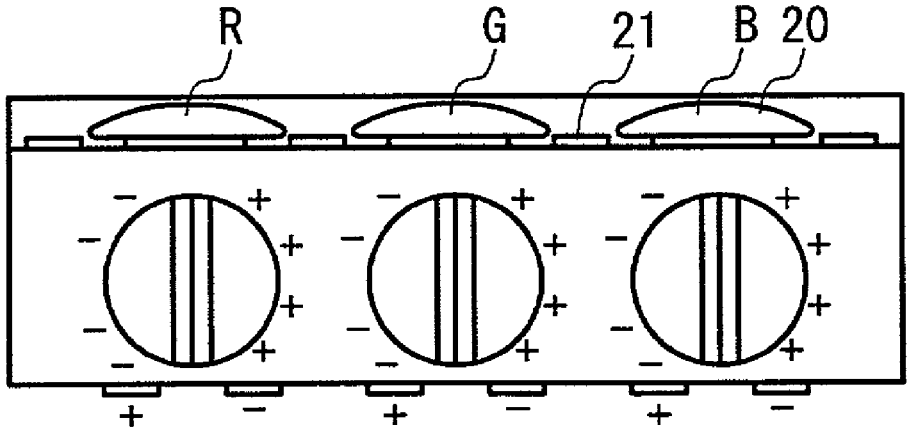

Furthermore, in a case where the lens was formed in the display device, two configurations are possible as shown in FIG. 20. In one configuration shown in FIG. 20A, the lens is used simply as a lens. In this configuration, a lens 20 and a black matrix 21 are formed on the surface of the substrate and a color filter itself is provided in a pixel. In another configuration shown in FIG. 20B, the lens 20 itself is provided with the color filter. Both configurations makes it possible to display a color image efficiently.

Seventh Embodiment

Hereinafter, the arrangement and configuration of a digital paper using a display device according to the seventh embodiment of the present invention will be explained. FIG. 21 is a perspective view showing a digital paper according to the seventh embodiment of the present invention.

By using the display device according to the present invention, it is possible to realize the display device having a thickness as thin as a paper. The display device having a configuration that is the same as paper materials distributed in a meeting etc. is referred to as "digital paper".

Figure 21A:
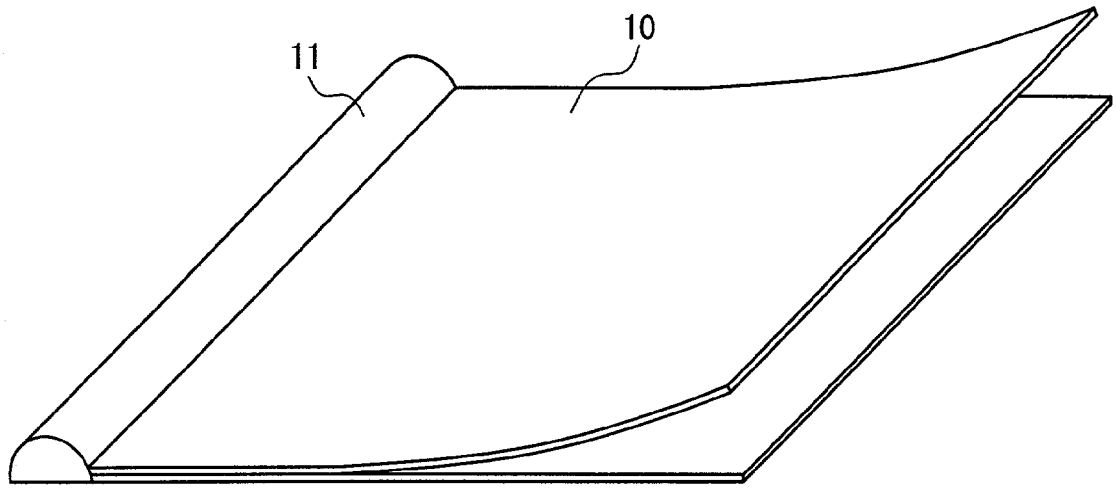
FIGS. 21A to 21B are perspective views showing a configuration of a digital paper system using a display device according to a seventh embodiment of the present invention.

In FIG. 21A, a display portion is located in the center of a digital paper 10. The base material is preferably an organic material. Furthermore, a charged substance constituting a pixel also is an organic material. Main part of the display portion is made of an organic material. Equipment such as a circuit, an antenna, or the like, which is necessary for receiving and sending information, are formed inside a hook 11 for connecting a plurality of digital papers 10. Furthermore, a control circuit for controlling the display on the digital paper 10 is formed in the hook 11.

The difference of the display device of the present invention from the conventional display device is in that different contents can be displayed in a plurality of display portions at the same time. In other words, in a method of displaying a plurality of windows to show the different contents, each content cannot be seen well or displayed contents cannot be confirmed unless scrolling is carried out. In the seventh embodiment, without sacrificing the veiwability, much information can be displayed.

Figure 21B:
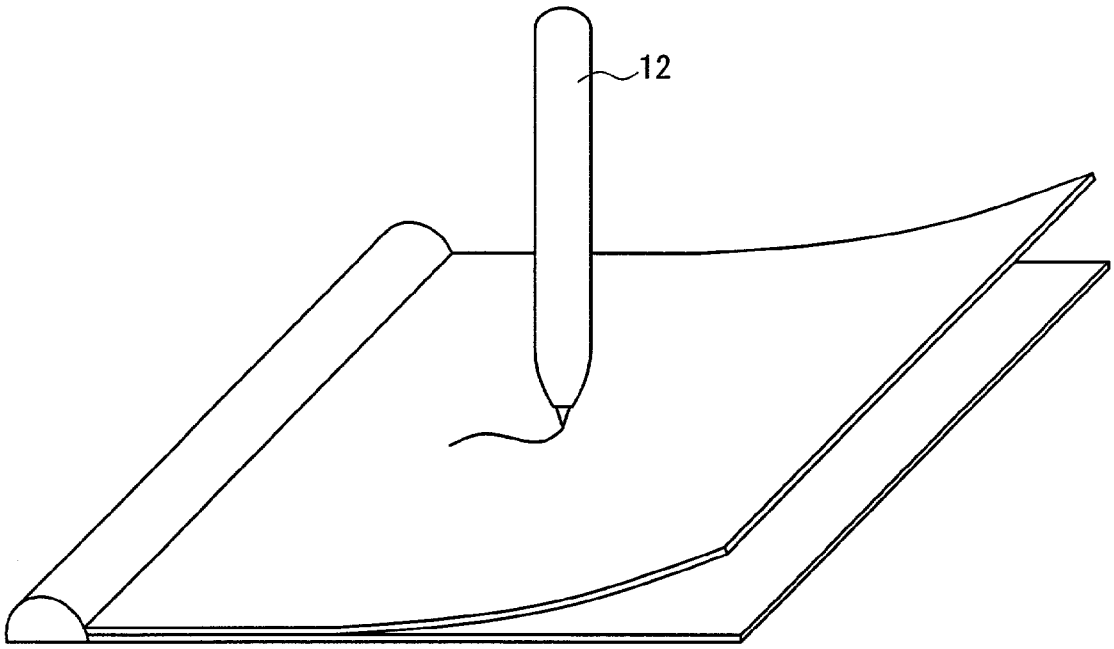

Furthermore, as shown in FIG. 21B, by using an electronic pen 12 etc. having an electric field generation portion on its tip, it is possible to write arbitrary letters or to draw arbitrary pictures on the digital paper. In other words, as to the pixels provided with an electric field by the electron pen 12, if, for example, the tip portion of the electron pen 12 is positively charged, the cylinder-shaped pixels are rotated in the direction so that the surface of the negatively charged portion is turned to the front surface. Then, with the effect of memory peculiar to the display device according to the present invention, the pass of the electric pen 12 is stored in the display portion on the digital paper 10. Consequently, the operation like drawing with a pen can be carried out on the digital paper 10.

On the other hand, since it is easy to search the distribution of charges in the displayed portion, it is possible to transfer the content to be displayed to another digital paper via the connecting means. For example, in a teleconference system etc., a presenter underlines a portion to be noted, the information is transmitted simultaneously sent (broadcast) to the digital paper 10 of all of the participants via arbitrary communication means and each participant can recognize the underlined portion on their own digital paper 10 at the same time. In such various a usage patterns, the display device of the present invention can perform applications that have not been able to be performed with conventional display devices.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A display device comprising a plurality of charged substances in different charged states or with opposite polarities in two regions of a surface area of a base material, wherein an organic monomolecular film is bonded and fixed to a part of or an entire surface of the base material having a volume of less than 1 $cm^3$ via —A—O— bond, where A denotes Si, Ge, Sn, Ti or Zr, or via —A—N— bond, where A denotes Si, Ge, Sn, Ti or Zr; the surface region of the base material is divided into two regions in accordance with the kind of organic monomolecular films or the presence or absence of the organic monomolecular film; and each of the two regions accounts for 40% or more and 60% or less of the surface area of the base material; and wherein the plurality of charged substances are dipped in liquid between a pair of substrates each having an electrode, and voltage is applied to the electrodes, thereby enabling the charged substances to be rotated.

2. The display device according to claim 1, wherein at least one of the substrates is equipped with a color filter.

3. The display device according to claim 1, wherein the film thickness of the organic monomolecular film is 100 nm or less.

4. The display device according to claim 1, wherein the base material of the charged substance has a sphere shape.

5. The display device according to claim 1, wherein the base material of the charged substance has a cylinder shape.

6. A display device comprising:

a plurality of charged substances in different charged states or with opposite polarities in two regions of a surface area of a base material, wherein an organic film is bonded and fixed to a part of or an entire surface of the base material having a volume of less than 1 $cm^3$ via —A—O— bond, where A denotes Si, Ge, Sn, Ti or Zr, or via —A—N— bond, where A denotes Si, Ge, Sn, Ti or Zr; the surface region of the base material is divided into two regions in accordance with the kind of organic films or the presence or absence of the organic film; and each of the two regions accounts for 40% or more and 60% or less of the surface area of the base material;

wherein the plurality of charged substances are dipped in liquid between a pair of substrates each having an electrode, and voltage is applied to the electrodes thereby enabling the charged substances to be rotated;

wherein the liquid has a high resistance of $10^4$ Ω cm or more; and wherein the organic film comprises adsorbed water and is in contact with the high resistance liquid.

7. The display device according to claim 6, wherein the organic film adsorbs water containing electrolytes and is in contact with the high resistance liquid.

8. The display device according to claim 6, wherein the organic film adsorbs water by a surfactant.

9. The display device according to claim 9, wherein the surfactant has both a cationic property and an anionic property.

10. The display device according to claim 1, wherein the difference between the refractive index of the transparent substrate located in a light path where light enters, passes through and is reflected from and the refractive index of the liquid is 0.1 or less.

11. The display device according to claim 1, wherein the film thickness of the electrode has an odd multiple of one-half the light wavelength.

12. The display device according to claim 1, wherein each of the charged substances functions as a pixel and each pixel is provided with at least one lens.

13. The display device according to claim 1, wherein the lens is provided on the substrate located at the side of a viewer.

14. The display device according to claim 6, wherein the difference between the refractive index of the transparent substrate located in a light path where light enters, passes through and is reflected from and the refractive index of the liquid is 0.1 or less.

15. The display device according to claim 6, wherein the film thickness of the electrode has an odd multiple of one-half the light wavelength.

16. The display device according to claim 6, wherein each of the charged substances functions as a pixel and each pixel is provided with at least one lens.

17. The display device according to claim 16, wherein the lens is provided on the substrate located at the side of a viewer.

* * * * *

UNITED STATES PATENT AND TRADEMARK OFFICE

CERTIFICATE OF CORRECTION

PATENT NO. : 6,985,132 B2
APPLICATION NO. : 09/995511
DATED : January 10, 2006
INVENTOR(S) : Nomura et al.

It is certified that error appears in the above-identified patent and that said Letters Patent is hereby corrected as shown below:

Col. 33, Line 6: "according to claim 9" should read --according to claim 8--

Signed and Sealed this

Fifth Day of December, 2006

JON W. DUDAS
*Director of the United States Patent and Trademark Office*